US006868250B2

(12) United States Patent
Takagi et al.

(10) Patent No.: US 6,868,250 B2
(45) Date of Patent: Mar. 15, 2005

(54) FIXING MECHANISM FOR USE IN IMAGE FORMING APPARATUS

(75) Inventors: Osamu Takagi, Tokyo (JP); Satoshi Kinouchi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/791,755

(22) Filed: Mar. 4, 2004

(65) Prior Publication Data

US 2004/0165916 A1 Aug. 26, 2004

Related U.S. Application Data

(63) Continuation of application No. 10/154,970, filed on May 28, 2002, now Pat. No. 6,725,000.

(30) Foreign Application Priority Data

May 28, 2001 (JP) ..... 2001-159449

(51) Int. Cl.[7] ..... G03G 15/20
(52) U.S. Cl. ..... 399/328; 399/330
(58) Field of Search ..... 399/67, 69, 320, 399/328, 329, 330, 335, 336, 338

(56) References Cited

U.S. PATENT DOCUMENTS

| | | | | |
|---|---|---|---|---|
| 4,585,325 A | | 4/1986 | Euler | |
| 5,526,103 A | * | 6/1996 | Kato et al. | 399/328 |
| 5,666,627 A | * | 9/1997 | Yamaguchi | 399/330 |
| 5,752,150 A | * | 5/1998 | Kato et al. | 399/330 |
| 5,794,096 A | * | 8/1998 | Okabayashi | 399/69 X |
| 5,819,134 A | | 10/1998 | Sato et al. | |
| 5,822,669 A | * | 10/1998 | Okabayashi et al. | 399/330 |
| 5,842,079 A | | 11/1998 | Miyamoto et al. | |
| 5,862,436 A | | 1/1999 | Ishizawa et al. | |
| 6,008,829 A | | 12/1999 | Wakamiya et al. | |
| 6,026,273 A | | 2/2000 | Kinouchi et al. | |
| 6,078,781 A | | 6/2000 | Takagi et al. | |
| 6,175,713 B1 | * | 1/2001 | Uehara et al. | 399/329 X |
| 6,188,054 B1 | | 2/2001 | Ohta | |
| 6,292,647 B1 | | 9/2001 | Ishida | |
| 6,292,648 B1 | | 9/2001 | Higaya et al. | |
| 6,320,168 B1 | | 11/2001 | Kimata et al. | |
| 6,337,969 B1 | | 1/2002 | Takagi et al. | |
| 6,353,718 B1 | | 3/2002 | Roxon et al. | |
| 6,438,335 B1 | | 8/2002 | Kinouchi et al. | |
| 6,643,476 B1 | | 11/2003 | Kinouchi et al. | |
| 6,643,491 B2 | | 11/2003 | Kinouchi et al. | |

FOREIGN PATENT DOCUMENTS

| | | |
|---|---|---|
| JP | 8-76620 A | 3/1996 |
| JP | 9-258586 A | 10/1997 |

OTHER PUBLICATIONS

U.S. Appl. No. 09/699,472, Kinouchi et al., filed Oct. 31, 2000.

* cited by examiner

*Primary Examiner*—Sandra L. Brase
(74) *Attorney, Agent, or Firm*—Foley & Lardner LLP

(57) ABSTRACT

In a fixing mechanism which heats a fixation member by generating heat in an endless member by using an induction current obtained from a current flowing through an induction coil, the present invention is characterized in that the induction coil is divided into a plurality of coils in a direction vertical to a moving direction of the fixation member and a coil to which power is supplied is switched according to needs.

12 Claims, 17 Drawing Sheets

FIXING MECHANISM FOR USE IN IMAGE FORMING APPARATUS

The present application is a continuation of U.S. application Ser. No. 10/154,970, filed May 28, 2002 now U.S. Pat. No. 6,725,000, the entire contents of which are incorporated therein by reference.

CROSS-REFERENCE TO RELATED APPLICATIONS

This application is based upon and claims the benefit of priority from the prior Japanese Patent Application No. 2001-159449, Filed May 28, 2001, the entire contents of which are incorporated herein by reference.

BACKGROUND OF THE INVENTION

The present invention relates to a fixing mechanism which fixes a toner image (image) on a fixation member in an image forming apparatus such as an electro-static process copying machine or a laser printer, and more particularly to a fixing mechanism using an induction heating method.

A fixing mechanism incorporated in a copying apparatus using an electrophotographic process heats and fuses toner which is a developer formed on a fixation member and fixes the toner on the fixation member. As a method for heating the toner which can be used in the fixing mechanism, a method using radiant heat from a halogen lamp is widely utilized.

As the method using the halogen lamp as a heat source, there is extensively used a structure in which a pair of rollers are provided so as to be capable of providing a predetermined pressure to the fixation member and the toner and a cylindrical halogen lamp is arranged in an inner space of at least one of the rollers as a hollow cylinder. In this structure, the roller having the halogen lamp arranged therein forms an action portion (nip) at a position where it is brought into contact with the other roller and provides the pressure and heat to the fixation member and the toner guided to the nip. That is, the fixation member, namely, paper is passed through a fixation point which is a pressure welding portion (nip) between a heating roller to which the lamp is provided and a pressure roller which rotates in accordance with the heating roller, and the toner on the paper is fused and then fixed onto the paper.

In the fixing mechanism using the halogen lamp, light and heat from the halogen lamp are radiated in the circumferential direction of the heating roller and the entire heating roller is heated. In this case, taking the loss when light is converted into heat and the efficiency or the like when warming the air in the roller and transmitting the heat to the roller into consideration, the heat exchange effectiveness is 60 to 70%. Further, it is known that the heat efficiency is low, the power consumption is large and the warming-up time is prolonged.

In order to solve the above-described problems inherent to the heater fixation, as shown in Jpn. Pat. Appln. KOKAI Publication No. 9-258586 or Jpn. Pat. Appln. KOKAI Publication No. 8-76620, there is proposed a fixing mechanism using a technique of induction heating.

Jpn. Pat. Appln. KOKAI Publication No. 9-258586 discloses a fixing mechanism which passes a current to an induction coil obtained by winding a coil around a core provided along a rotational axis of a fixing (metal) roller and generating an induction current to the roller in order to heat the metal roller itself.

Further, Jpn. Pat. Appln. KOKAI Publication No. 8-76620 discloses a fixing mechanism which has a conductive film accommodating therein magnetic field generating means and a pressure roller pressed against the conductive film and fixes the toner on a recording medium carried between the conductive film and the pressure roller onto the recording medium by causing the conductive film to generate heat.

For the purpose of reducing the warming-up time, in the fixing mechanism having a thinner heat roller or the fixing mechanism which adopts a belt or the like, a temperature hysteresis distribution is apt to appear on the heat roller depending on a size of the paper inserted and only a part through which the paper has passed consumes the heat energy. Therefore, irregularities in temperature are generated, and hence temperature control or a partial heating method which does not depend on the paper size is required in the fixing apparatus to which induction heating is applied in particular.

BRIEF SUMMARY OF THE INVENTION

It is an object of the present invention to provide a fixing mechanism including an electromagnetic induction coil, which does not generate a temperature distribution in the heat roller or irregularities in temperature due to a size of the paper to be carried.

According to the present invention, there is provided a heating mechanism comprising:

a first coil body and a second coil body, each coil body of which increases a temperature of an object;

a first temperature detection mechanism and a second temperature detection mechanism, the first temperature detection mechanism detecting a temperature which is a result of increase in temperature of the object when a predetermined output is supplied to the first coil body, and the second temperature detection mechanism detecting a temperature which is a result of increase in temperature of the object when the predetermined output is supplied to the second coil body; and an output control mechanism capable of alternately supplying the predetermined output to each of the first coil body and the second coil body;

wherein the output control mechanism continuously supplies the predetermined output to the first coil body until the first temperature detection mechanism detects that a temperature in an area of the object which is increased by the first coil body reaches a predetermined temperature as a result of increase in temperature of the object by the first coil body, and does not supply the predetermined output to the second coil body while the predetermined output is supplied to the first coil body.

Further, according to the present invention, there is provided a fixing mechanism comprising:

a first coil body which increases a temperature of an object and a second coil body which increases a temperature of the object;

a first temperature detection mechanism which detects a temperature which is a result of increase in temperature of the object when a predetermined output is supplied to the first coil body, and a second temperature detection mechanism which detects a temperature which is a result of increase in the object when the predetermined output is supplied to the second coil body; and an output control mechanism which supplies the predetermined output to each of the first coil body and the second coil body, the output control mechanism being capable of alternately supplying the predetermined output to either of the first coil body or the second coil body or simultaneously supplying the predetermined output to both the first and second coil bodies, wherein, in case of supplying the first predetermined output and the second predetermined output to the first coil body and the second coil body, the output control mechanism gradually increases a magnitude of the first and second predetermined outputs at fixed intervals until either the first predetermined output or the second predetermined output is supplied to at least one of the coil bodies from the off state of all the respective coil bodies and heating force output from the coil body to which that output is supplied reaches a predetermined magnitude.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments according to the present invention will now be described in detail hereinafter with reference to the accompanying drawings.

Figure 1:
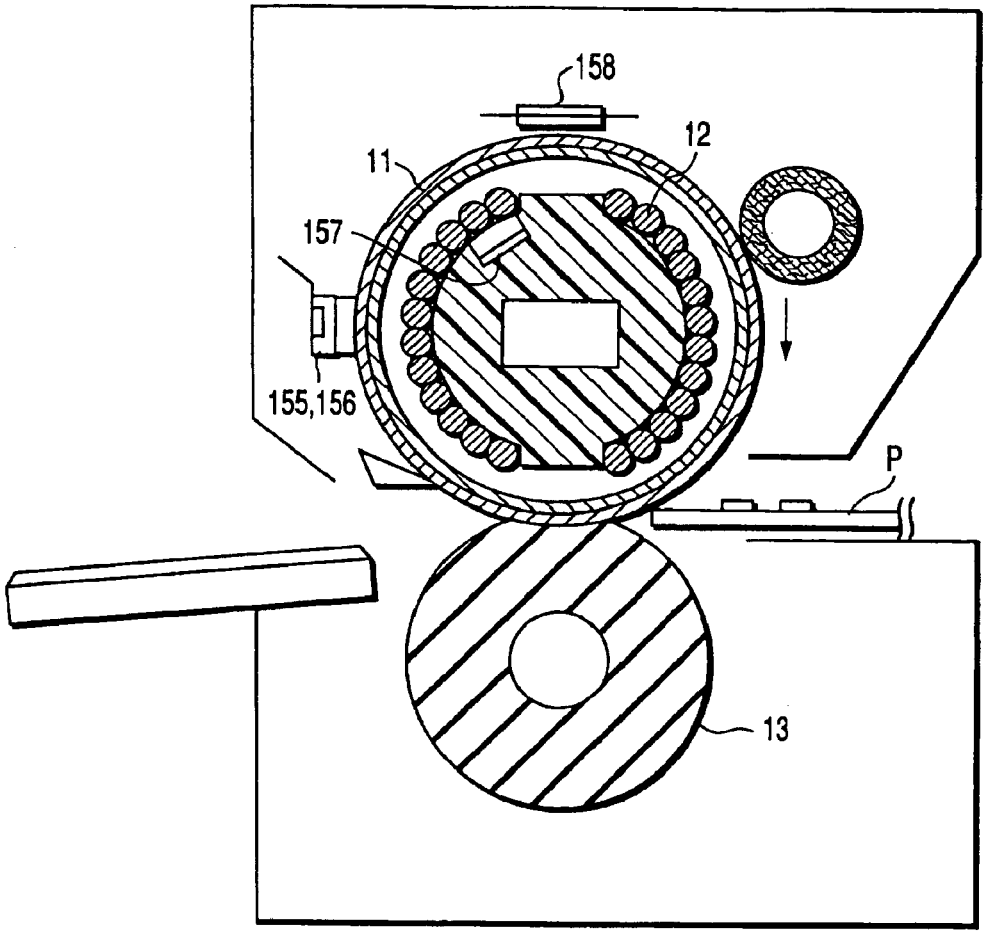
FIG. 1 is a view showing a primary part of a fixing mechanism to which an electromagnetic induction coil according to an embodiment of the present invention is applied.

FIG. 1 is a schematic view showing a primary part of a fixing mechanism in which an induction coil which will be described hereinafter is incorporated as various kinds of modifications according to the present invention.

In FIG. 1, a heat roller 11 receives drive force supplied from non-illustrated drive transmitting means provided at an end portion in the longitudinal direction, and is rotated in a direction indicated by an arrow.

Eddy currents are generated in the heat roller 11 when an alternating magnetic field is generated in induction coil 12 which is magnetic field generating means provided inside the heat roller 11 from a high-frequency circuit which will be described later in connection with FIG. 14A or 15, and the heat roller 11 thereby generates heat from the Joule heat.

A pressure roller 13 is in contact with a predetermined position on an outer peripheral surface of the heat roller 11 by a non-illustrated pressure applying mechanism. As a result, a predetermined contact width, namely, a nip is defined between the pressure roller 13 and the heat roller 11. Furthermore, since the pressure roller 13 is brought into contact with the heat roller 11 by a predetermined pressure, the pressure roller 13 rotates in accordance with (heat roller 11) rotation of the heat roller 11.

A fixation material P is passed through the nip between the heat roller 11 and the pressure roller 13 and, at this moment, an image, i.e., toner is fixed onto the fixation material P by the Joule heat.

In the example shown in FIG. 1, iron having an outside diameter of 60 mm and a thickness of 1.0 mm is used for the heat roller 11.

When such a heat roller 11 having a small wall thickness and a small heat capacity is used, a surface temperature of the heat roller 11 greatly varies depending on a size of the fixation member, namely, paper passed through the nip between the rollers. Therefore, the heat energy must be replenished in a short time to a part where the temperature is greatly lowered. However, it is known that irregularities in temperature (increase in temperature at a part where no paper is passed) become prominent in the rotational axis direction (longitudinal direction) of the heat roller 11 when the temperature of the roller 11 is controlled by controlling power supplied to the coil 12 so as to be capable of replenishing the heat energy over the entire area of the heat roller 11 in the longitudinal direction.

Figure 2A:
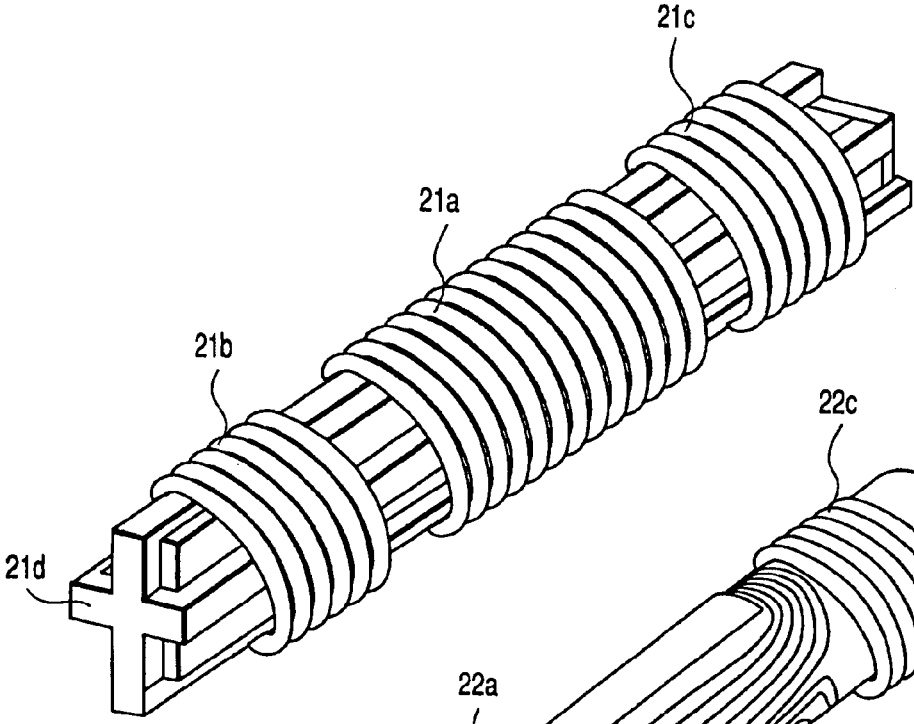
FIGS. 2A to 2C are schematic views showing examples of an induction coil which can be applied to the fixing mechanism depicted in FIG. 1 and consists of three air coils divided in the longitudinal direction.
Figure 2B:
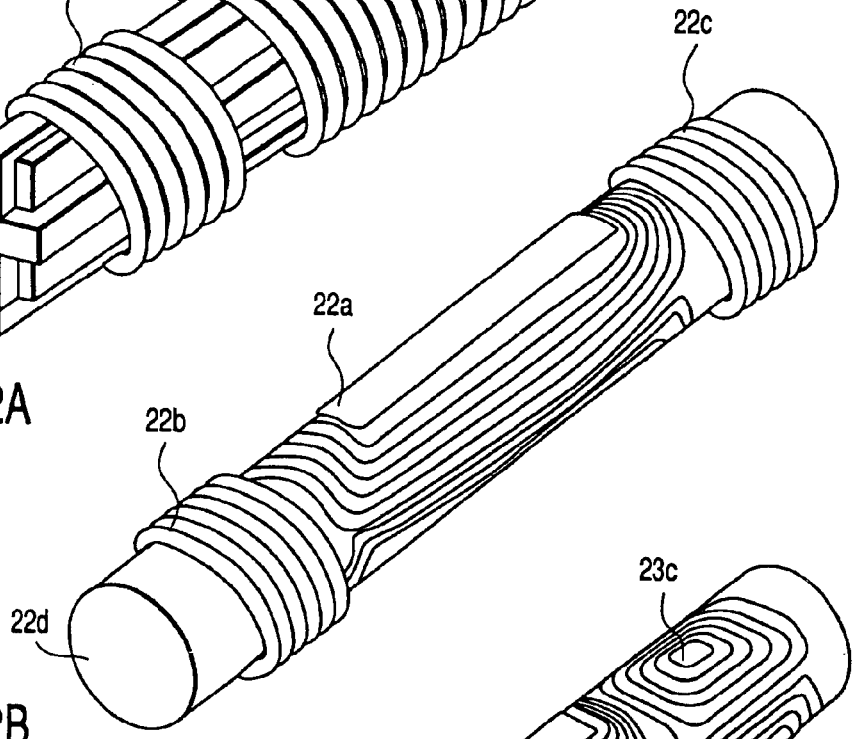
Figure 2C:
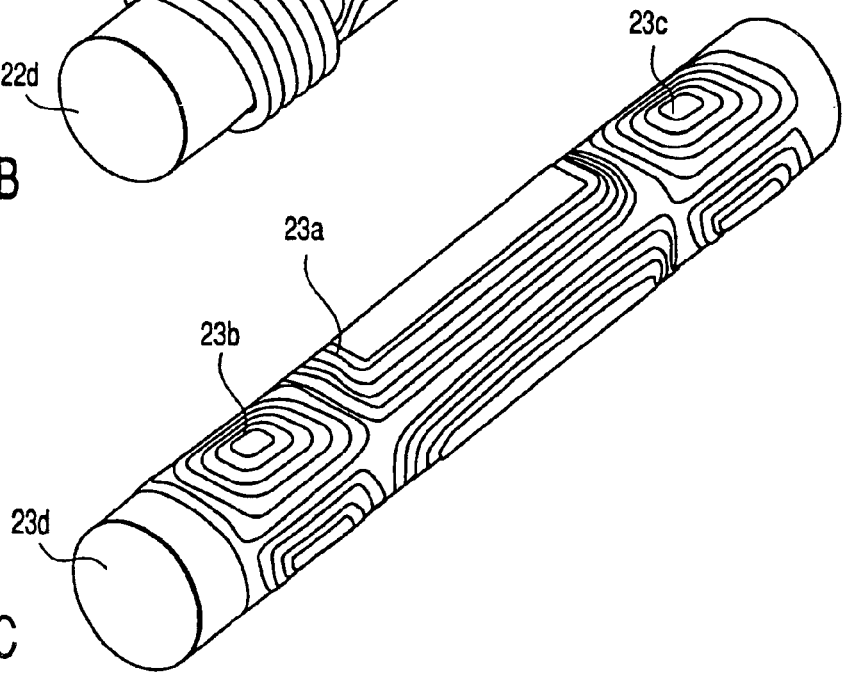

FIGS. 2A to 2C illustrate examples of an electromagnetic induction coil which can be applied to the fixing mechanism depicted in FIG. 1 and consists of air coils divided into three in the longitudinal direction.

The respective electromagnetic coils illustrated in FIGS. 2A to 2C are air coils divided into three, and consist of central coils 21*a*, 22*a* and 23*a* and two end coils 21*b*, 22*b*, 23*b* and 21*c*, 22*c* and 23*c*. The both end coils 21*b*, 22*b*, 23*b* and 21*c*, 22*c* and 23*c* are operated in the same control mode.

The central coil and the both end coils of the electromagnetic induction coil shown in FIG. 2A are so-called solenoid type coils each of which is wound around the center of the rotational axis of the heat roller. The two end coils of the electromagnetic induction coil shown in FIG. 2B are solenoid type coils and the central coil of the same is a so-called spiral planar coil which extends in the longitudinal direction. The central coil and the two end coils of the electromagnetic induction coil shown in FIG. 2C are planar coils.

All the electromagnetic induction coils shown in FIGS. 2A to 2C are air coils, as they do not have a magnetic substance core. The air coil can achieve reduction in weight since it does not have a heavy magnetic substance core, and the heat generation efficiency of the air coil is not lowered because it does not have a problem of a Curie point that the magnetic substance core has.

In order to bring out the necessary coil performance by using the air coil, a large current must be caused to flow. Therefore, an electric wire material used for the induction coil 12 must have a thickness (cross-sectional area) which can withstand the large current.

When a frequency of power supplied is higher than a predetermined frequency due to the well-known skin effect even if a thick electric wire is used, however, it is difficult to assure an apparent (effective) cross-sectional area of the electric wire material. Thus, as the electric wire material forming the coil, there is used a Litz wire obtained by individually insulating and coating thin single-line wire materials on which a penetration depth of the skin effect does not have an impact and twisting the wires which can assure a predetermined cross-sectional area. In the fixing mechanism shown in FIG. 1, the wire obtained by twisting 19 heat-resistant enamel wires (polyimide coated) each having a diameter of 0.5 mm is used for each induction coil 12 except the case which will be additionally described hereunder.

The induction coil 12 has an entire length of 320 mm. The length of the central coil 21*a* (22*a*, 23*a*) which is one of the three divided parts in the longitudinal direction of the heat roller 11 is formed to a length that a magnetic field generated by the central coil can increase the temperature with a width of, e.g., 220 mm in the vicinity of the center of the heat roller 11 in the longitudinal direction.

That is, in an electrophotographic type copying machine or a printer apparatus which is extensively used as an image forming apparatus, an image forming condition by which a number of times of printing output becomes maximum is that the paper of A4 size is carried with a short side (width: 210 mm) direction being in a direction orthogonal to a direction along which the paper is carried.

In this case, even if only the central coil 21*a* (22*a*, 23*a*) is operated, at least 210 mm alone must be capable of increasing the temperature. Incidentally, since heat is passed to the both end portions in the longitudinal direction of the heat roller 11 due to thermodiffusion of the heat roller 11, the length of the central coil 21*a* (22*a*, 23*a*) in the axial direction is set to a length that a magnetic field generated by the central coil can increase the temperature in the vicinity of the center in the longitudinal direction of the heat roller 11 with a width of approximately 230 mm.

As shown in FIGS. 2A to 2C, the respective coil electric wires are wound around supports 21*d*, 22*d* and 23*d* having various kinds of shapes. The supports 21*d*, 22*d* and 23*d* must have the heat resistance, and a material such as polyimide, heat-resistant phenol or liquid crystal polymer can be used.

Further, coil electric wires can be fixed on the surfaces of the supports 21*d*, 22*d* and 23*d* by applying silicon-based varnish, thereby suppressing vibrations of the coils or the like.

As described above, the induction coil 12 is divided into a plurality of pieces along the longitudinal direction of the heat roller 11, and at least one of the divided coils is determined as an air coil, thereby inexpensively forming the induction coil with a light weight.

FIGS. 3A to 3E illustrate examples of an electromagnetic induction coil which can be applied to the fixing mechanism depicted in FIG. 1 and in which the coil electric wire of the three air coils divided in the longitudinal direction is set to an angle inclined to the rotational axis direction of the heat roller from the vertical direction by a predetermined angle. It is to be noted that reference numeral add up "10" denotes structures which are identical with or similar to those in the induction coil explained in connection with FIGS. 2A to 2C, thereby omitting the detailed description.

In the three coils divided in the longitudinal direction explained in conjunction with FIGS. 2A to 2C, each divided coil can be energized according to needs and temperature control can be performed. However, when all the coils are simultaneously energized or when the central coil and the coils on the both ends are alternately energized considering the upper limit of power which can be inputted, it is confirmed that heat generation is lowered at a joint between the respective divided coils.

When heat generation is lowered at the joint in this manner, it is known that a difference in fixation ratio is generated at the joint portion or gloss on the surface of the outputted paper is changed. Moreover, wrinkles may be produced when a difference is generated to such an extent that the paper is extended.

Figure 3A:
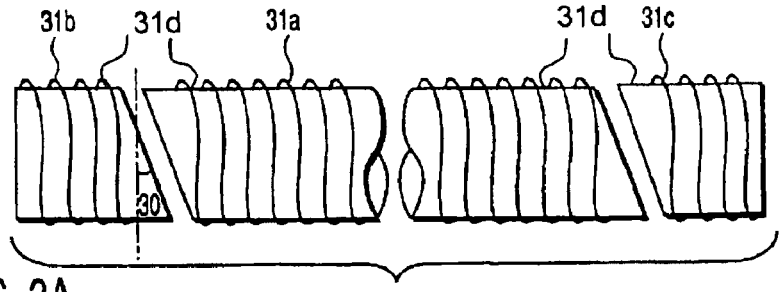
FIGS. 3A to 3E are schematic views showing examples of an induction coil which can be applied to the fixing mechanism depicted in FIG. 1 and in which a coil electric wire of the three air coils divided in the longitudinal direction is set to an angle inclined to the rotational axis direction of a heat roller from the vertical direction by a predetermined angle.
Figure 3B:
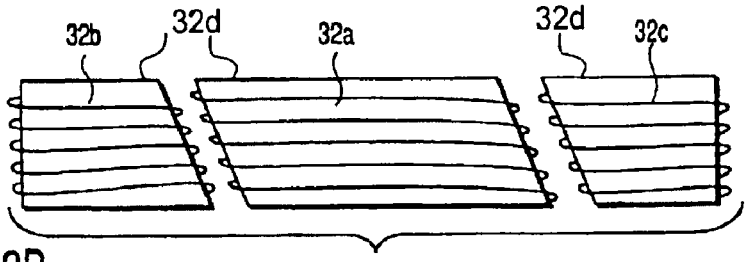
Figure 3C:
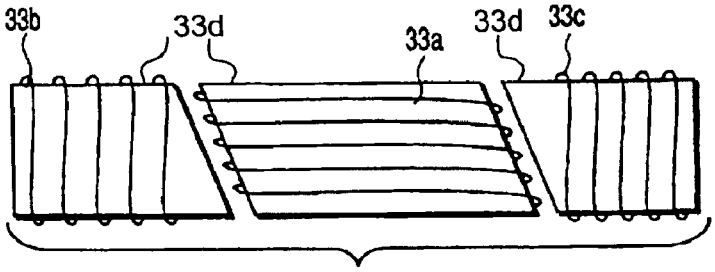
Figure 3D:
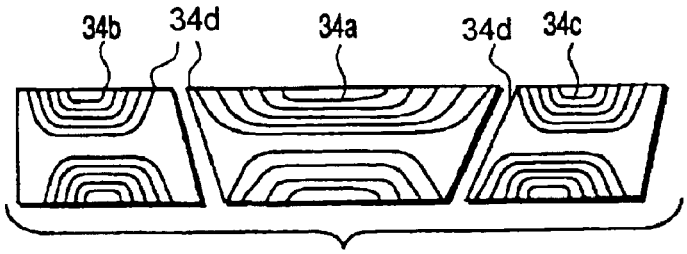
Figure 3E:
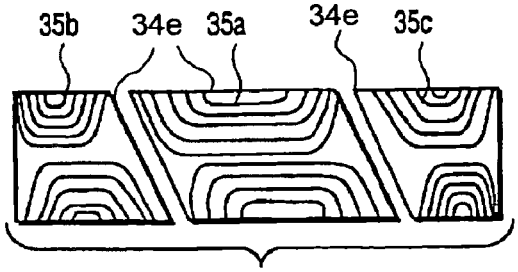

Therefore, as shown in FIG. 3A, the induction coil 12 is divided into three coils, i.e., the central coil 31*a* and the two end coils 31*b* and 31*c*, and the electric wire of each coil is inclined to the rotational axis direction of the heat roller 11 from the vertical direction by a predetermined angle, which is 30° in FIG. 3A, when it is wound. An angle by which the electric wire material should be inclined is such an angle as that the cut line of the coil 12 cannot be seen when viewing in a direction parallel to the longitudinal direction of the heat roller 11. For example, it is set to 5° or 60°.

In the induction coil shown in FIG. 3A, each turn of the respective coils 31*a*, 31*b* and 31*c* is wound while being inclined by a predetermined angle as described above. In the induction coil shown in FIG. 3B, a position of each turn of the respective coils 32*a*, 32*b* and 32*c* is staggered in the vertical direction. In the induction coil depicted in FIG. 3C, each turn of the central coil 33*a* is staggered in the vertical direction, while each turn of the both end coils 33*b* and 33*c* is inclined by a predetermined angle. In the induction coil shown in FIG. 3D, a length of one coil of the central coil 34*a* including two planar coils is defined to be longer than that of the other coil. Similarly, a length of each coil of the both end coils 34*b* and 34*c* including two planar coils is defined to be opposite to the length of the central coil. In the induction coil shown in FIG. 3E, the central coil 35*a* staggers positions of the upper coil and the lower coil, and the coil length of the upper coil of the end coil 35*b* is smaller whilst the coil length of the lower coil of the same is larger. In this structure, the coil length of the upper coil of the end coil 34*c* is large, while the coil length of the lower coil of the same is small.

By winding the electric wire material as shown in FIGS. 3A to 3E in case of winding the electric wire material, a heat generation length of each coil partially differs in the longitudinal direction of the heat roller 11. Therefore, although a temperature lowers at the joint portion, positions of the joints do not match with each other in the axial direction when the heat roller 11 is rotated. Thus, in the winding method shown in FIGS. 2A to 2C, although reduction in temperature up to 30° C. occurs at the joint portion, this reduction can be suppressed within 10° C. As a result, it is possible to suppress generation of a difference in fixation ratio at the joint part or a change in gloss on the surface of the outputted paper, and wrinkles can be prevented from being produced due to occurrence of a difference to such an extent as that the paper is extended.

As shown in FIGS. 3A to 3E, respective coil electric wires are wound around the supports 31*d*, 32*d*, 33*d*, 34*d* and 34*e* having various kinds of shapes. It is to be noted that the supports must have the heat resistance and polyimide, heat-resistant phenol, liquid crystal polymer or the like can be used for the supports.

The coil shape is not restricted to those illustrated in FIGS. 3A to 3E, and the similar advantage can be expected as long as the adjacent coils are inclined at the same angle. Further, if not all the coils are air coils and a coil having the magnetic substance core is included, or if all the coils have the magnetic substance cores, a similar effect can be expected.

Figure 4A:
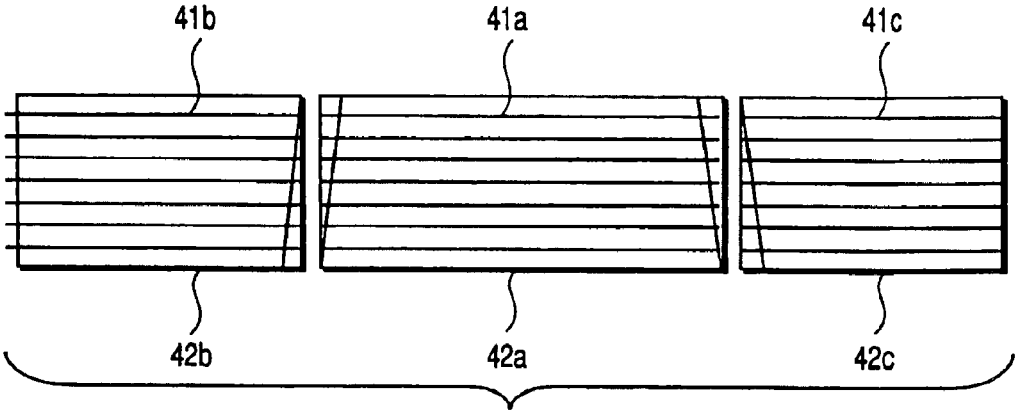
FIGS. 4A and 4B are schematic views showing examples of an induction coil which can be applied to the fixing mechanism depicted in FIG. 1 and in which a magnetic substance core of the three air coils divided in the longitudinal direction is set to an angle inclined to the rotational axis direction of the heat roller from the vertical direction by a predetermined angle.
Figure 4B:
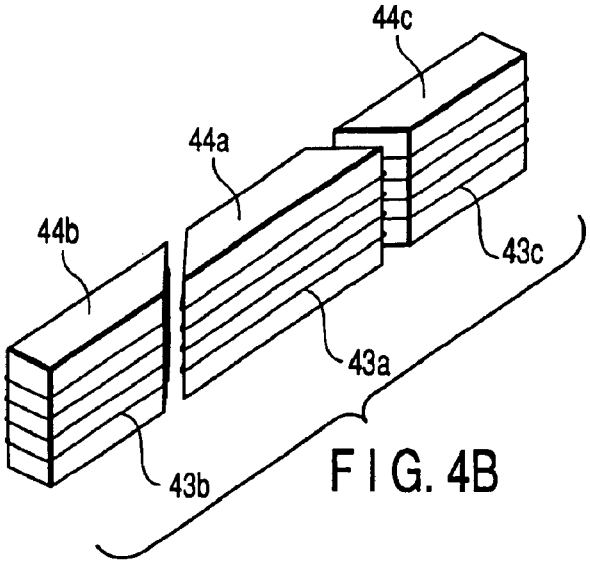

FIGS. 4A and 4B illustrate examples of an electromagnetic induction coil which can be applied to the fixing mechanism shown in FIG. 1 and in which a magnetic substance core of the air coil divided into three in the longitudinal direction is set at an angle inclined to the rotation axis direction of the heat roller from the vertical direction by a predetermined angle.

As shown in FIG. 4A, the induction coil is divided into to three coils, i.e., a central coil 41*a* and two end coils 41*b* and 41*c*, and cores 42*a*, 42*b* and 42*c* constituted by the magnetic substance are inclined at a predetermined angle to the rotational axis direction of the heat roller to the axial direction. Although the inclination angle is not restricted to a specific angle, an angle ranging from 5° to 60° is preferable.

The induction coil according to this embodiment is different from the examples described with reference to FIGS. 2A to 2C and FIGS. 3A to 3E, and it is a coil having the magnetic substance core. It is to be noted that coils which have the same shape and are wound in the axial direction of the heat roller are used for the respective coils.

As bobbins of the magnetic substance cores 42*a*, 42*b* and 42*c*, they must have the heat resistance, and polyimide, heat-resistant phenol, liquid crystal polymer or the like may be used. The coil electric wire can be fixed by applying silicon-based varnish on the surface of this bobbin, thereby suppressing vibrations of the coils.

Incidentally, the coil shape is not restricted to that shown in FIG. 4A, and a similar advantage can be expected if the end portions of the adjacent magnetic substance cores are inclined at the same angle. For example, when coils 43*a*, 43*b*, and 43*c* are formed by winding electric wires around magnetic cores 44*a*, 44*b*, and 44*c*, which are arranged to form a predetermined angle, as shown in FIG. 4B, a similar advantage can be obtained. Alternatively, a shape obtained by combining the shape shown in FIG. 4A with that illustrated in FIG. 4B can suffice.

Furthermore, all the coils includes at least one of the type having the magnetic substance core and at least one of the air coil is included, the similar advantage can be expected.

As described above, in the induction coils shown in FIGS. 4A and 4B, the coil is configured to be divided into a plurality of coils, and the core consisting of the magnetic substance is configured to have an angle inclined from a direction vertical to the rotational axis direction of the heat roller by a predetermined angle. Therefore, even if all the divided coils are energized in order to cope with the paper of a large size, reduction in heat generation at the joints of the coils can be suppressed. As a result, it is possible to suppress generation of wrinkles or the like due to a difference in fixation ratio at the joint parts, a difference in degree of gloss on an image surface and a difference in extension of a paper.

FIGS. 5A to 5E illustrate examples of the shape which can be applied to the fixing mechanism shown in FIG. 1 and in which at least one of the upper and lower end portions of the magnetic substance core of the air coil divided into three in the longitudinal direction in the vicinity of the joint is caused to protrude.

As shown in FIGS. 5A to 5E, the induction coil is divided into three coils, i.e., a central coil 51*a* and two end coils 51*b* and 51*c*, the cores 52*a* to 56*c* constituted by the magnetic substance are caused to protrude at least at one of the upper and lower end portions thereof, and the coil electric wire is accommodated therein. By providing such a shape of the end portion of each core, the magnetic flux slightly extends from the end portion of the coil toward the heat roller as compared with the case where the end portion is not caused to protrude. As a result, parts with the low magnetic flux density are decreased at the end portions of the respective coils, thereby suppressing reduction in heat generation.

Although the protruding length of the end portion of each core is not particularly restricted, a length ranging from approximately 2 mm to 10 mm is preferable.

Figure 5A:
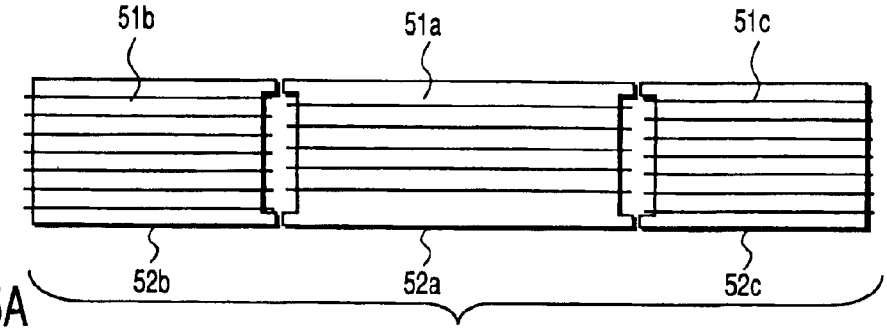
FIGS. 5A to 5E are schematic views illustrating examples of a shape which can be applied to the fixing mechanism depicted in FIG. 1 and in which at least one of upper and lower end portions of the three air coils divided in the longitudinal direction in the vicinity of a joint of the magnetic substance core is caused to protrude.
Figure 5B:
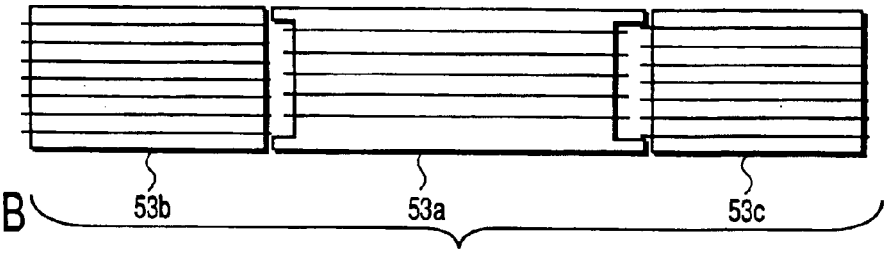
Figure 5C:
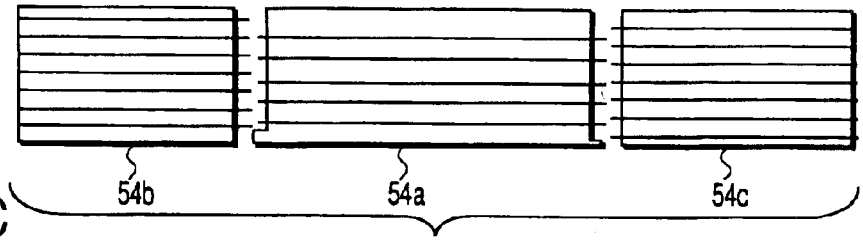

In the induction coil shown in FIG. 5A, the upper and lower end portions of the cores 52*a*, 52*b* and 52*c* protrude. In the induction coil shown in FIG. 5B, the upper and lower end portions of only the central core 53*a* protrude. In the induction coil shown in FIG. 5C, the lower end portion of only the central core 54*a* protrudes.

Figure 5D:
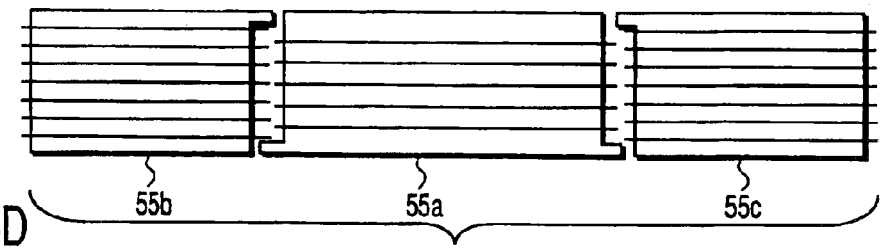
Figure 5E:
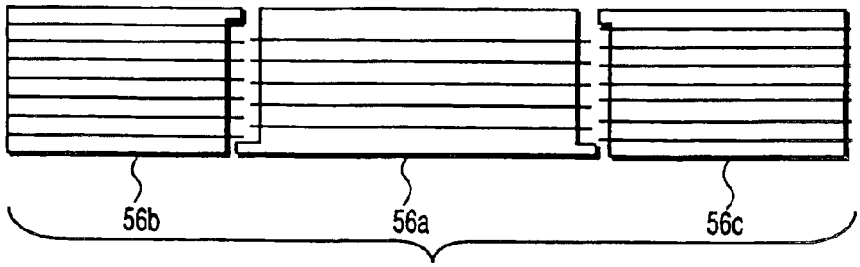
Figure 22A:
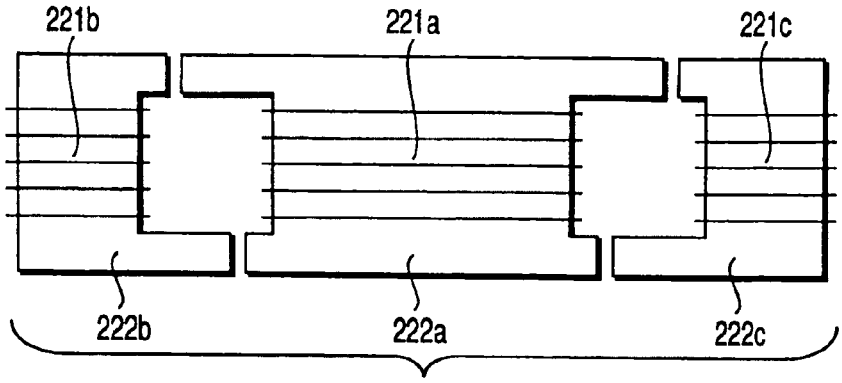
FIGS. 22A to 22C are schematic views showing examples of yet another embodiment of the induction coils depicted in FIGS. 5A to 5E.
Figure 22B:
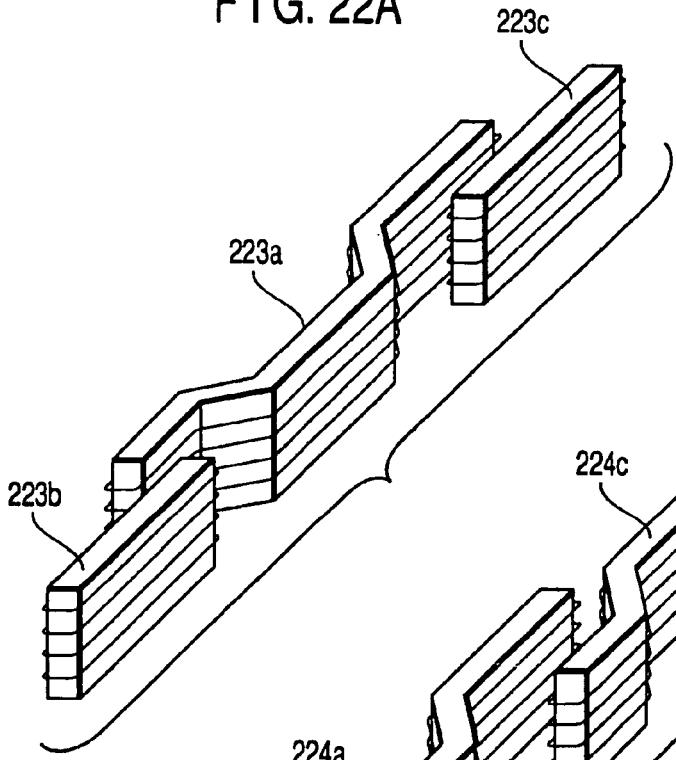
Figure 22C:
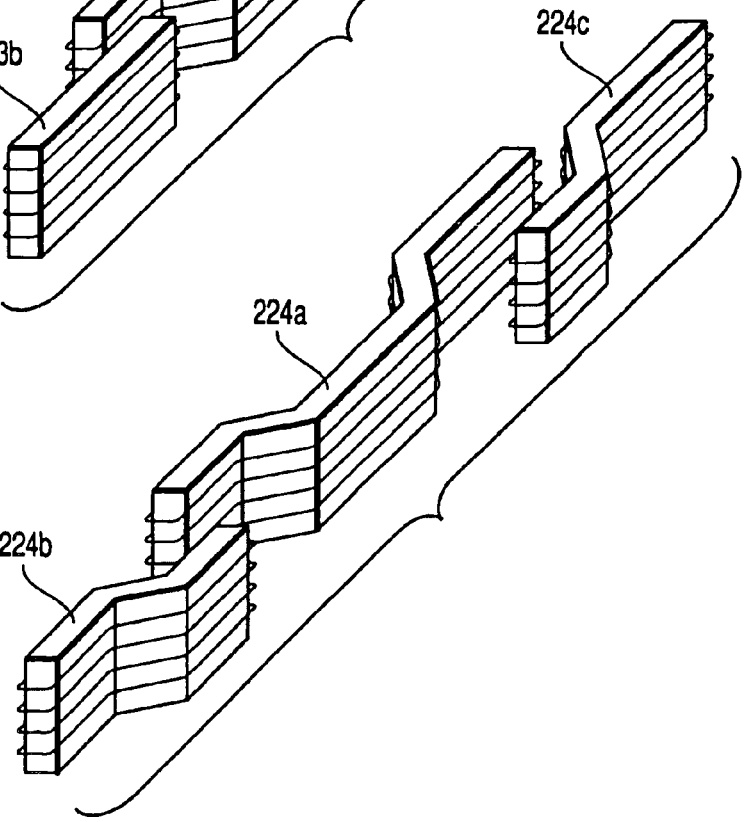

In the induction coil shown in FIG. 5D, the lower end portion of only the central core 54*a* and the upper end portions of the cores 55*b* and 55*c* at both ends largely protrude. In the induction coil shown in FIG. 5E, the lower end portion of only the central core 54*a* and the upper end portions of the cores 55*b* and 55*c* at the both ends slightly protrude. It is to be noted that the respective induction coils may be formed in such a manner that the individual coils 221*a*, 221*b*, 221*c* and the cores 222*a*, 222*b*, 222*c*, 223*a*, 223*b*, 223*c*, 224*a*, 224*b* and 224*c* partly overlap each other when seen from a direction parallel to the longitudinal direction of the heat roller as shown in FIGS. 22A to 22C.

Incidentally, this advantage can be effectively demonstrated when a distance from the core end portion to the heat roller is shorter than a minimum distance between the adjacent cores.

The induction coil according to this embodiment is different from the examples explained in connection with FIGS. 2A to 2C and 3A to 3E, and it is a coil having the magnetic substance core. It is to be noted that coils which have the same shape and are wound in the axial direction of the heat roller are used for the respective cores.

As bobbins of the magnetic substance cores shown in FIGS. 5A to 5E, they must have the heat resistance, and polyimide, heat-resistant phenol, liquid crystal polymer or the like may be used. The coil electric wire can be fixed by applying silicon-based varnish on the surface of this bobbin, thereby suppressing vibrations of the coil.

It is to be noted that the coil shape is not restricted those illustrated in FIGS. 5A to 5E, and the similar advantage can be expected if the end portion of each magnetic substance core protrudes. Moreover, even if all the coils made from at least one of the magnetic substance core type and at least one of an air coil is included, the similar advantage can be expected.

Figure 6A:
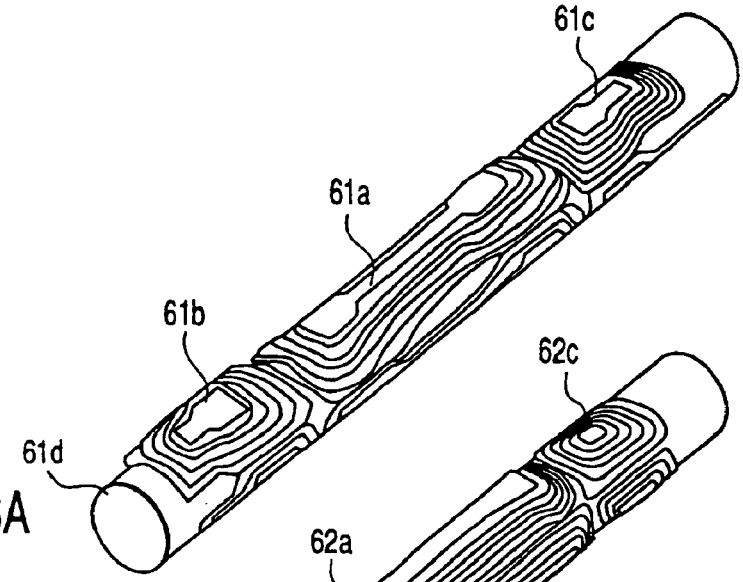
FIGS. 6A and 6B are schematic views illustrating examples of an induction coil which can be applied to the fixing mechanism depicted in FIG. 1 and in which a distance between opposed coil electric wires (pair) in the vicinity of a joint of the three air coils divided in the longitudinal direction is enlarged.
Figure 6B:
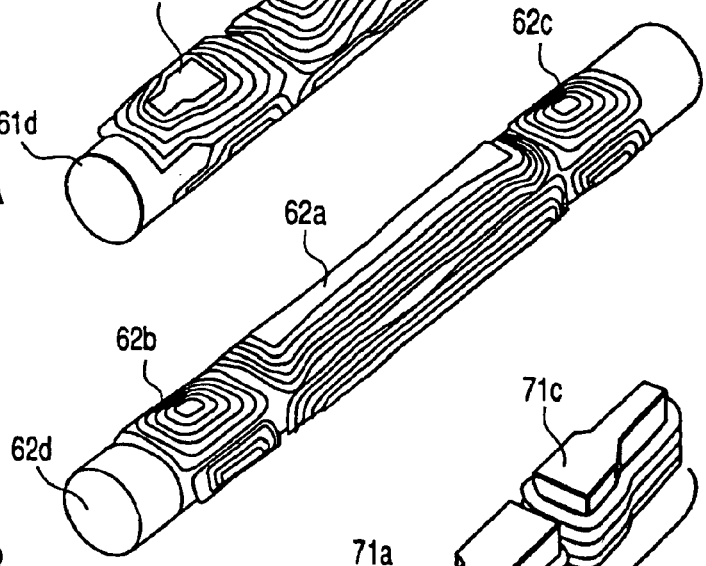

FIGS. 6A and 6B illustrate examples of an electromagnetic induction coil which can be applied to the fixing mechanism depicted in FIG. 1 and in which a distance between opposed coil electric wires (pair) is enlarged in the vicinity of the joint of the air coil divided into three in the longitudinal direction.

In the examples shown in FIGS. 6A and 6B, a distance between opposed coil electric wires (pair) is enlarged in regard to winding of the coil in the vicinity of the end portion without changing the coil forming method and the outer shape.

Therefore, reduction in generation of the magnetic flux at the joint of the coil is prevented, and heat generation at the both ends of each coil is facilitated.

In the induction coil shown in FIG. 6A, a distance between opposed electric wires at adjacent parts of the end portions of the coils 61*a*, 61*b* and 61*c* is enlarged. In the induction coil shown in FIG. 6B, a distance between opposed electric wires at the end portion of only the central coil 62*a* is formed in such a manner that its coil portion opposed to the end coils 62*b* and 62*c* are arranged at long intervals.

The enlarged distance between the opposed electric wires at the coil end portion is not particularly restricted, it is preferable to adopt a distance which is 1.1 to 2-fold the distance between the opposed electric wires at the center of the coil in the longitudinal direction.

Incidentally, in this embodiment, the distance between the opposed electric wires at each of the both ends of the coil having a length of 20 mm is enlarged by 5 mm, thereby increasing a temperature on the conductor corresponding to the joint of the coil by 10° C. or more.

The induction coil according to this embodiment is an air coil having no magnetic substance core similar to those described in connection with FIGS. 2A, 2B, 2C, 3A, 3B, 3C, 3D and 3E.

As shown in FIGS. 6A and 6B, the respective coil electric wires are wound around supports 61*d* and 62*d*.

Incidentally, the coil shape is not restricted to those illustrated in FIGS. 6A and 6B, and the similar advantage can be expected if it is configured in such a manner that a distance between the opposed electric wires at the coil end portion is enlarged. In addition, if not all the coils are air coils and a coil which is of a type having the magnetic substance core is included, the similar advantage can be expected.

Figure 7A:
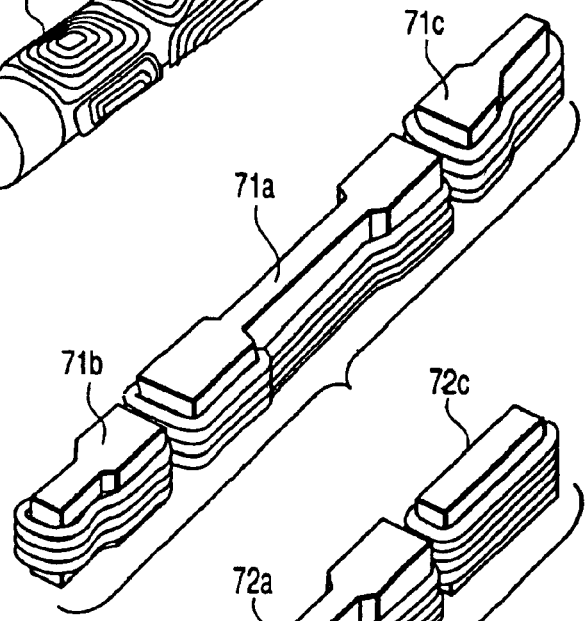
FIGS. 7A and 7B are schematic views illustrating examples of an induction coil which can be applied to the fixing mechanism depicted in FIG. 1 and in which a width of the magnetic substance core in the vicinity of a joint of the three air coils divided in the longitudinal direction is widened.
Figure 7B:
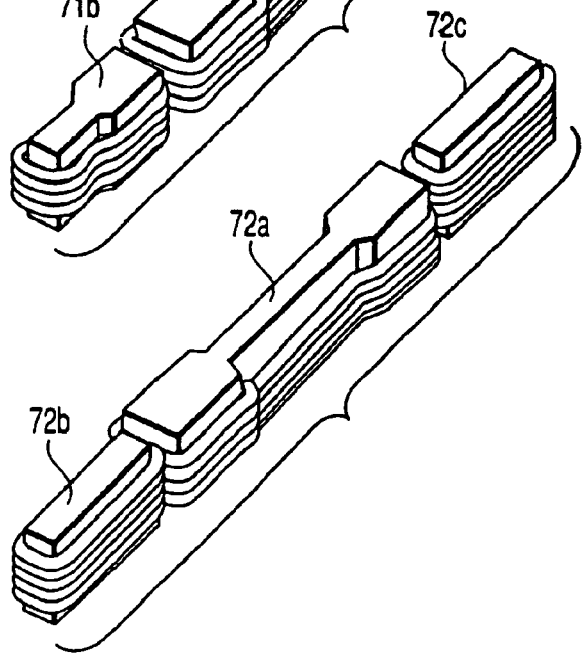

FIGS. 7A and 7B illustrate examples of an electromagnetic induction coil which can be applied to the fixing mechanism illustrated in FIG. 1 and in which a width of the magnetic substance core is enlarged in the vicinity of the joint of the air coil divided into three in the longitudinal direction.

As shown in FIGS. 7A and 7B, a width of the magnetic substance core divided into three is changed, and the shape of the cross section is thereby changed at the end part and the central part. As a result, reduction in generation of the magnetic flux is prevented at the joint of the coil, and heat generation at the both ends of each divided coil is facilitated.

Incidentally, in the magnetic substance core shown in FIG. 7A, widths of the both ends of the central core 71*a* and widths of the end portions of the both end cores 71*b* and 71*c* adjacent to the central core 71*a* are enlarged. Additionally, in the magnetic substance core shown in FIG. 7B, widths of the both ends of the central core 72*a* are enlarged, and widths of the both end cores 72*b* and 72*c* are not changed in particular.

The enlarged width at the end portion of the magnetic substance core is not particularly restricted, but it is preferable to adopt a width which is approximately 1.1 to 2-fold of the width of the central part in the longitudinal direction of the magnetic substance core.

It is to be noted that each of the induction coils shown in FIGS. 7A to 7B is the coil having the magnetic substance core. Incidentally, coils which have the same shape and are wound in the axial direction of the heat roller can be used for the respective coils.

As bobbins of the magnetic substance cores 71*a*, 71*b* and 71*c*, 72*a*, 72*b*, and 72*c*, they must have the heat resistance. Incidentally, the core shape is not restricted to those illustrated in FIGS. 7A and 7B, and the similar advantage can be expected if the width of the end portion of the magnetic substance core is enlarged. Further, if not all the coils are of the type having the magnetic substance core and a coil which is of the type having the air coil is included, the similar advantage can be expected.

Figure 8A:
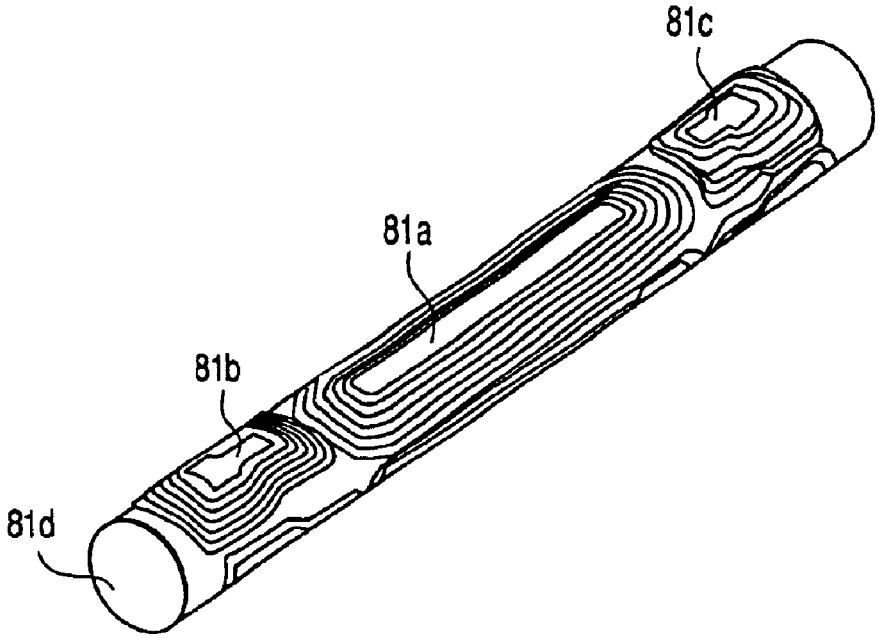
FIGS. 8A and 8B are schematic views illustrating examples of an induction coil which can be applied to the fixing mechanism depicted in FIG. 1 and in which a distance between opposed coil electric wires (pair) in the vicinity of the end portion of both end coils of the three air coils divided in the longitudinal direction is enlarged.
Figure 8B:
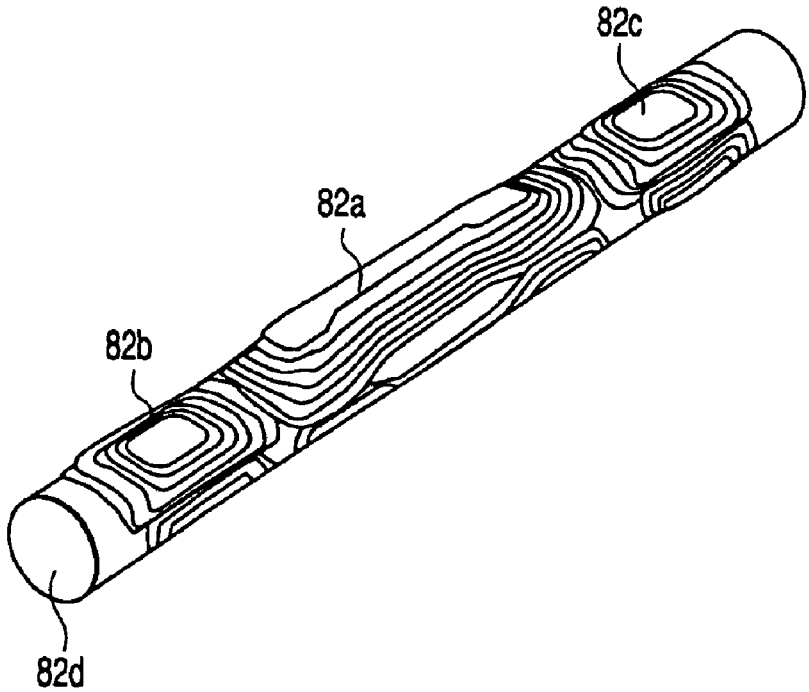

FIGS. 8A and 8B illustrate examples of the electromagnetic induction coil which can be applied to the fixing mechanism shown in FIG. 1 and in which a distance between opposed coil electric wires (pair) is enlarged in the vicinity of the end portions of the both end coils of the air coil divided into three in the longitudinal direction.

In FIGS. 8A and 8B, the winding is configured in such a manner that a distance between opposed coil electric wires (pair) is enlarged in the vicinity of the end portion of each of the both end coils without changing the coil forming method and the outer shape. As a result, reduction in the magnetic flux density at the both ends of the coil unit can be prevented, and heat generation at the both end portions of the coil unit is facilitated.

In the induction coil shown in FIG. 8A, a distance between opposed electric wires is enlarged at the outer end portion in the axial direction of each of the double-ended coils 81*b* and 81*c* without changing a distance between opposed electric wires of the central coil 81*a*, and a distance between opposed electric wires is not enlarged at the end portion adjacent to the central coil 81*a*.

In the induction coil shown in FIG. 8B, a distance between opposed electric wires is enlarged at each of the both end portions of the central coil 82*a*, and a distance between the opposed electric wires of each of the both end coils 82*b* and 82*c* is enlarged as a whole.

The enlarged distance between the opposed electric wires in each of the both end coils is not restricted in particular, but it is preferable to adopt a distance which is approximately 1.1 to 2-fold of the non-enlarged distance between the opposed electric wires.

Incidentally, in this embodiment, the distance between the opposed electric wires in each of the both end coils having a length of 30 mm is enlarged by 3 mm, thereby increasing a temperature of the conductor corresponding to the both end portions of the coil unit by 10° C. or more.

The respective coil electric wires are wound around supports 81*d* and 82*d* as shown in FIGS. 8A and 8B.

It is to be noted that the coil shape is not restricted to those shown in FIGS. 8A and 8B, and a similar advantage can be expected if it is configured in such a manner that a distance between the opposed electric wires is enlarged at each end portion of the both end coils. Furthermore, even if all the coils are the air coils and a coil which is of the type having the magnetic substance core is included, the similar advantage can be expected.

As described above, according to the embodiment shown in FIGS. 8A and 8B, the coil is configured to be divided into a plurality of coils and enlarge the distance between the opposed coil electric wires (pair) in the vicinity of the end portion of the both end coils. Therefore, even if all of the divided coils are energized in order to cope with the paper of a large size, reduction in heat generation can be suppressed at the end portions of the coil unit.

Figure 9A:
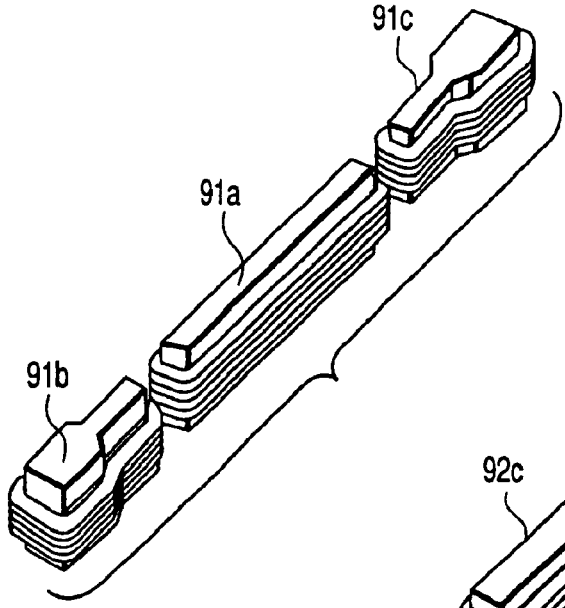
FIGS. 9A to 9C are schematic views illustrating examples of an induction coil which can be applied to the fixing mechanism depicted in FIG. 1 and in which a magnetic substance core end width of the both end coils of the three air coils divided in the longitudinal direction is widened.
Figure 9B:
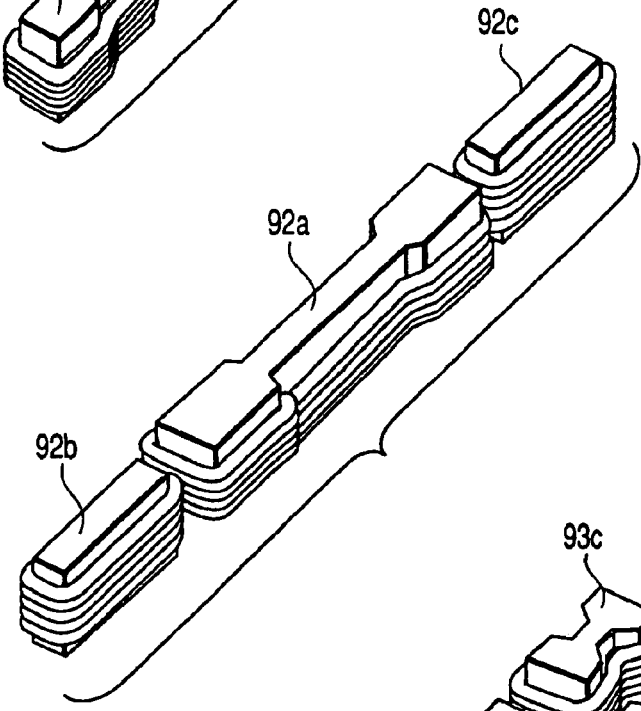
Figure 9C:
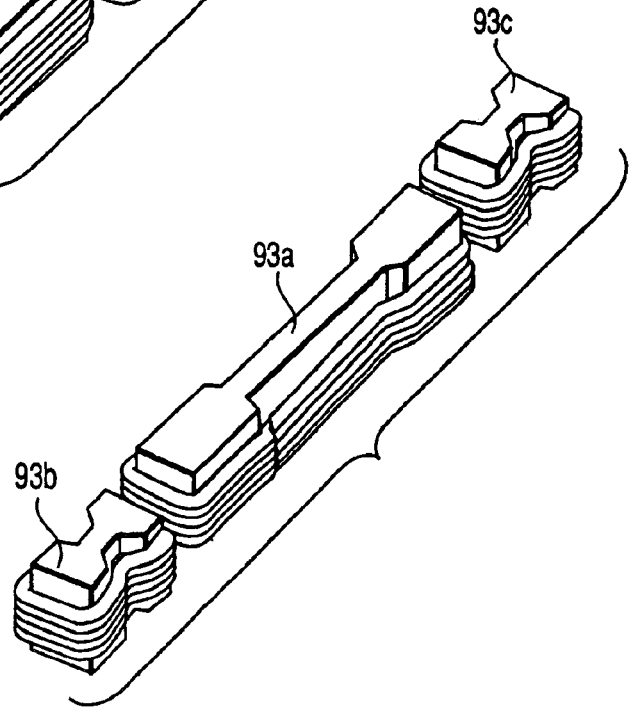

FIGS. 9A to 9C illustrate examples of an electromagnetic induction coil which can be applied to the fixing mechanism shown in FIG. 1 and in which a width of the magnetic substance core end portion of each of the both end coils of the air coil divided into three in the longitudinal direction is enlarged.

In FIGS. 9A to 9C, a width of the magnetic substance core divided into three is changed, and the shape of the cross section is thereby changed at the end portions and the central portion. As a result, reduction in generation of the magnetic flux is prevented at the both ends of the coil unit, and heat generation at the both end portions of the coil unit is facilitated.

In the magnetic substance core shown in FIG. 9A, a width of the central core 91*a* is not changed, but widths of the end portions of the both end cores 91*b* and 91*c* are enlarged. In the magnetic substance core shown in FIG. 9B, widths of the both end portions of the central core 92*a* and widths of the end portions of the both end cores 92*b* and 92*c* are enlarged. In the magnetic substance core shown in FIG. 9C, widths of all of the central core 93*a* and the both end cores 93*b* and 93*c* are enlarged with respect to the central part.

Although the enlarged width at each of the end portions of the magnetic substance core is not restricted in particular, it is preferable to adopt a width which is approximately 1.1 to 2-fold of the width of the non-enlarged part.

It is to be noted that a width at the end portion of each of the both end cores having a length of 30 mm is enlarged by 3 mm, thereby increasing a temperature on the conductor corresponding to the both end portions of the coil unit by 10° C. or more.

It is to be noted that the core shape is not restricted to those shown in FIGS. 9A to 9C, and the similar advantage can be expected if the width of each end portion of the magnetic substance core at the both ends is enlarged. Furthermore, all the coils are at least one of the type having the magnetic substance core and at least one of type having an air coil is included, a similar advantage can be expected.

As described above, by using the induction coils illustrated in FIGS. 9A to 9C, the coil is configured to be divided into a plurality of coils and enlarge the width in the vicinity of each end portion of the both end coils constituted by the magnetic substance. Therefore, reduction in heat generation at each end portion of the coil unit can be suppressed even if all the divided coils are energized in order to cope with the paper of a large size.

Figure 10A:
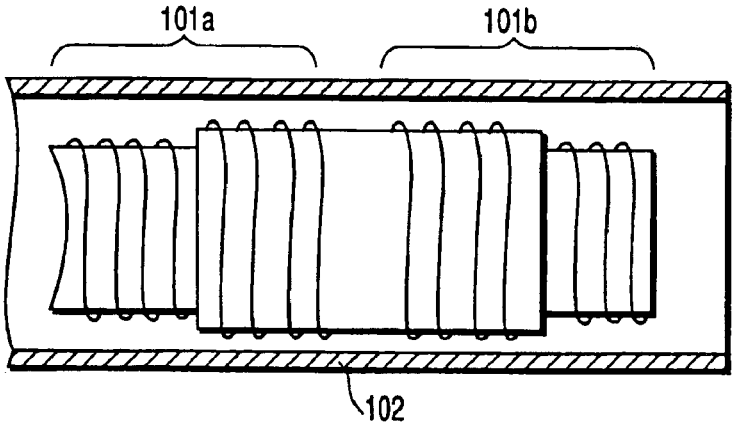
FIGS. 10A and 10B are schematic views illustrating examples of an induction coil which can be applied to the fixing mechanism shown in FIG. 1 and in which a distance between the coil electric wire and the heat roller in the vicinity of the joint of the air coils divided in the longitudinal direction is shortened.
Figure 10B:
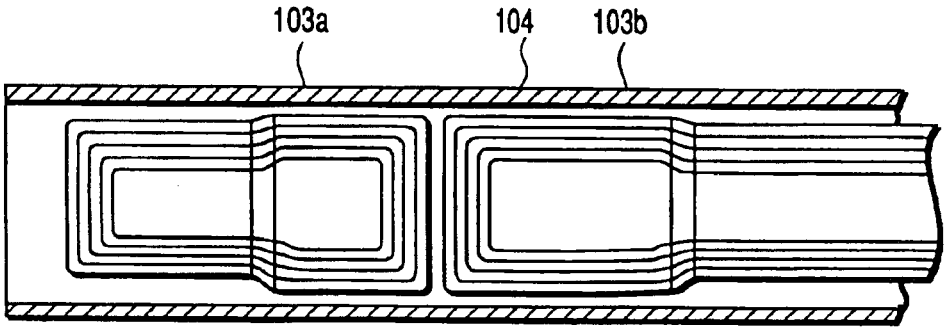

FIGS. 10A and 10B illustrate examples of an electromagnetic induction coil which can be applied to the fixing mechanism shown in FIG. 1 and in which a distance between the coil electric wire and the heat roller is shortened in the vicinity of the joint of the air coil divided in the longitudinal direction.

In the examples shown in FIGS. 10A and 10B, distances between the electric wires and the heat rollers 102 and 104 are reduced in the vicinity of a part between the divided adjacent coils 101*a* and 101*b* and in the vicinity of a part between the coils 103*a* and 103*b*. That is, the magnetic flux generated in the coil can be effectively caused to act on the heat roller, and heat generation at the both end portion of each of the divided coils can be facilitated.

In this embodiment, a distance between the electric wire and the heat roller is reduced by 1 mm along the length of 30 mm in the vicinity of the joint of the divided coils, thereby increasing a temperature of the conductor corresponding to the joint of the coils.

Incidentally, if not all the coils are air coils and a coil which is of the type having the magnetic substance core is included, a similar advantage can be expected.

As described above, in the induction coils illustrated in FIGS. 10A and 10B, the coil is configured to be divided into a plurality of coils and reduce a distance between the coil electric wire and a heating body in the vicinity of the end portions of the adjacent coils. Even if all the divided coils are energized in order to cope with the paper of a large size, reduction in heat generation at the joint of the coils can be suppressed, thereby restraining a difference in fixation ratio at the joint portion, a difference in degree of gloss on an image surface, and occurrence of wrinkles or the like due to a difference in extension of the paper.

Figure 11A:
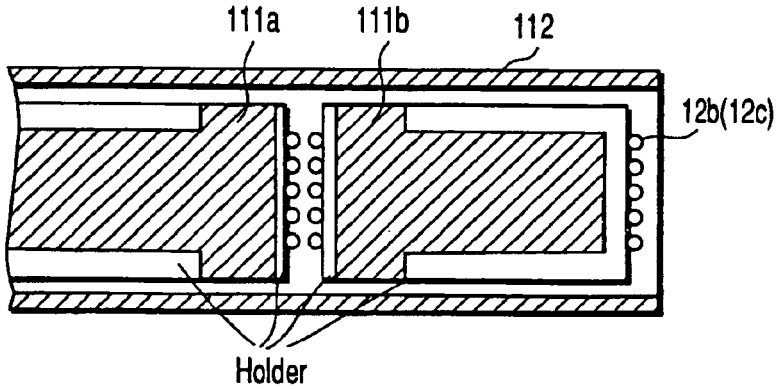
FIGS. 11A and 11B are views showing examples of an induction coil which can be applied to the fixing mechanism shown in FIG. 1 and in which a distance between the magnetic substance core and the heat roller in the vicinity of the joint of the air coils divided in the longitudinal direction is shortened.
Figure 11B:
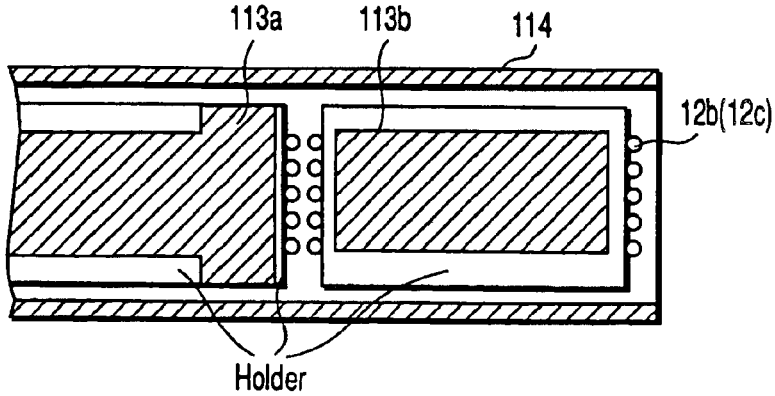

FIGS. 11A and 11B illustrate examples of an electromagnetic induction coil which can be applied to the fixing mechanism shown in FIG. 1 and in which a distance between the magnetic substance core and the heat roller is shortened in the vicinity of the joint of the air coil divided in the longitudinal direction.

In the example shown in FIG. 11A, distances between the part in the vicinity of the joint of the magnetic substance cores 111*a* and 111*b* of the divided adjacent coils 12*b* and 12*c* and the heat rollers 112 and 114 are reduced. As a result, the magnetic flux generated in the coil can be caused to effectively act on the heat roller, thereby facilitating heat generation at the both end portions of each divided coil. In FIG. 11B, a distance between the part in the vicinity of the joint of the magnetic core 113*a* adjacent to the magnetic substance core 113*b* and the heat roller 114 is shortened without changing the magnetic substance core 113*b* of the end coil.

In this embodiment, in the vicinity of the joint of the divided coils 12*b* and 12*c*, a distance between the magnetic substance core and the heat roller is shortened by 1 mm over the length of 30 mm, thereby increasing a temperature of the conductor corresponding to the joint of the coils.

Incidentally, the core shape is not restricted to those illustrated in FIGS. 11A and 11B, and a similar advantage can be expected if a large size of the end portion of the magnetic substance core can be assured in the vicinity of the joint and a distance to the heating body can be shortened.

Moreover, the shape is not restricted to those shown in FIGS. 11A and 11B, and all the coils do not have to be coils having the magnetic substance coil. Even if the air coil is included, a similar advantage can be expected.

As described above, by using the induction coils illustrated in FIGS. 11A and 11B, the coil is configured to be divided into a plurality of coils and shorten the distance between the end portion and the heating body in the vicinity of the joint of the cores constituted by the magnetic substance. Therefore, even if all the divided coils are energized in order to cope with the paper of a large size, reduction in heat generation at the joint of the coils can be suppressed, thereby restraining a difference in fixture ratio at the joint part, a difference in degree of gloss on an image surface and occurrence of wrinkles or the like due to a difference in extension of the paper.

Figure 12A:
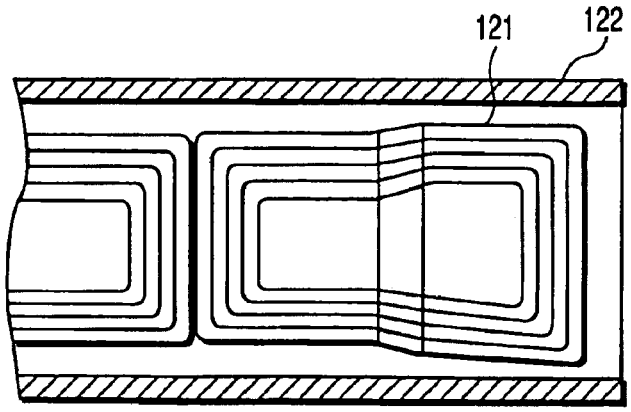
FIGS. 12A and 12B are schematic views illustrating examples of an induction coil which can be applied to the fixing mechanism illustrated in FIG. 1 and in which a distance between the coil electric wire and the heat roller in the vicinity of an end coil of the air coils divided in the longitudinal direction is shortened.
Figure 12B:
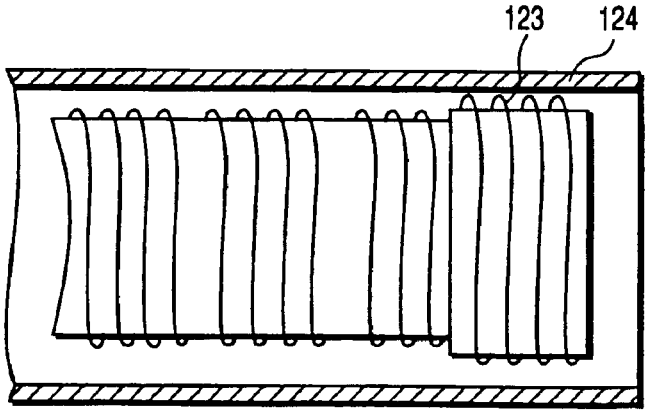

FIGS. 12A and 12B illustrate examples of an electromagnetic induction coil which can be applied to the fixing mechanism shown in FIG. 1 and in which a distance between the coil electric wire and the heat roller is shortened in the vicinity of each end coil of the air coil divided in the longitudinal direction.

In the examples shown in FIGS. 12A and 12B, the winding is configured in such a manner that distances between the coil electric wires and the heat rollers 122 and 124 are shortened in the vicinity of end portions of the both end coils 121 and 123 without changing the coil forming method and the outer shape. As a result, reduction in the magnetic flux density at the both ends of the coil unit can be prevented, and heat generation at the both end portions of the coil unit is facilitated.

It is to be noted that the distance between the coil electric wire and the heat roller is shortened by 1 mm along the length of 30 mm of each end portion of the both end coils, thereby increasing a temperature on the conductor corresponding to the both end portions of the coil unit.

As described above, by using the induction coils illustrated in FIGS. 12A and 12B, the coil is divided into a plurality of coils and the distance between the coil electric wire and the heated body is shortened in the vicinity of each end portion of the both end coils. As a result, even if all the divided coils are energized in order to cope with the paper of a large size, reduction in heat generation at the end portions of the coil unit can be suppressed.

Figure 13:
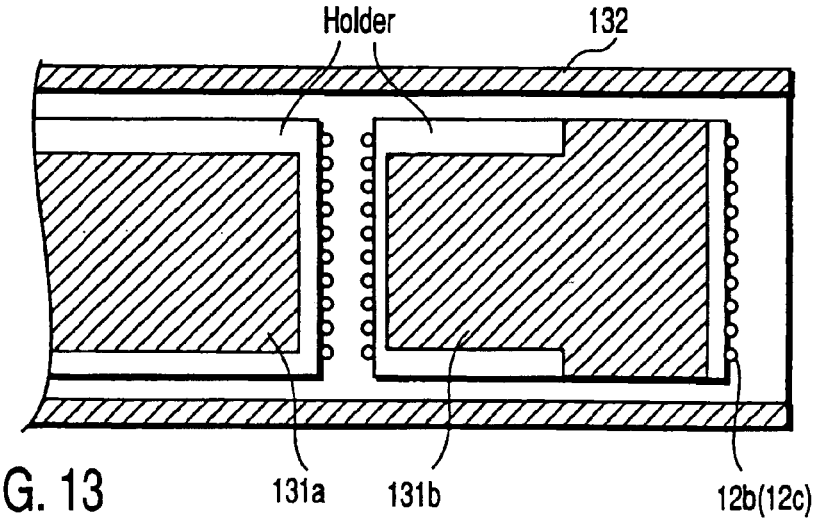
FIG. 13 is a schematic view illustrating an example of an induction coil which can be applied to the fixing mechanism depicted in FIG. 1 and in which a distance between the end portion of the magnetic substance core of the end coil of the air coils divided in the longitudinal direction and the heat roller is shortened.

FIG. 13 illustrates an example of an electromagnetic induction coil which can be applied to the fixing mechanism shown in FIG. 1 and in which a distance between the end portion of the electromagnetic core of the end coil of the air coil divided in the longitudinal direction and the heat roller is reduced.

In the induction coil depicted in FIG. 13, a distance between the heat roller 132 and the end portion of the magnetic substance core 131*b* of the both end coils among the divided coils is reduced. Nothing is changed in the adjacent magnetic substance core 131*a*. As a result, reduction in magnetic flux density can be prevented at the both ends of the coil unit, and heat generation at the both end portions of the coil unit is facilitated.

Incidentally, in this embodiment, a distance between the heat roller 132 and the magnetic substance core 131*b* is shortened by 1 mm over the length of 30 mm of the end portion of each of the both end coils, thereby increasing a temperature on the conductor corresponding to the both end portions of the coil unit by 10° C. or more.

Incidentally, if not all the coils are of the type having the magnetic substance core. Even if at least one of coil which is of the type having the air coil is included, a similar advantage can be expected.

As described above, in the induction coil shown in FIG. 13, the coil is divided into a plurality of coils, and the distance between the heating body and the end portion of each of the both end cores constituted by the magnetic substance is shortened. As a result, even if all the divided coils are energized in order to cope with the paper of a large size, reduction in heat generation at the end portion of the coil unit can be suppressed.

Figure 14A:
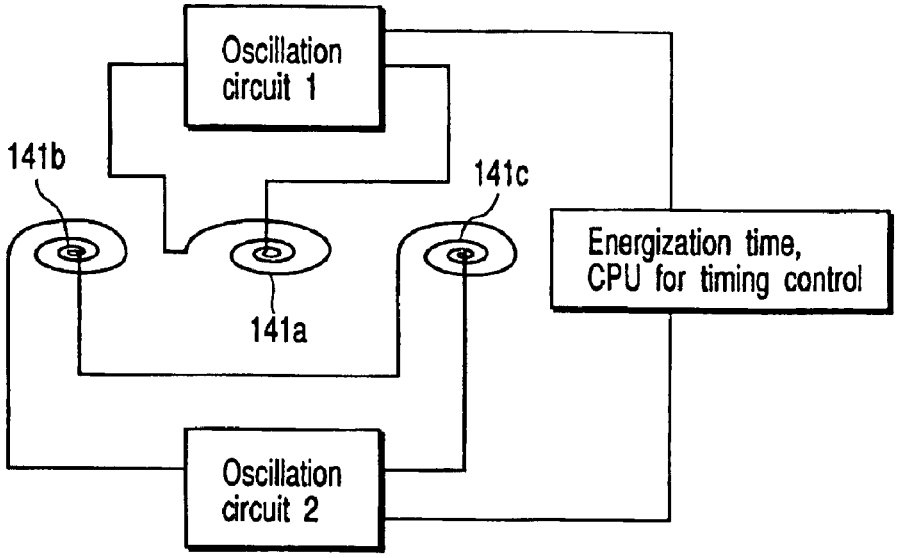
FIG. 14A is a schematic view showing an example of a drive device which can supply predetermined power to each coil of the fixing mechanism depicted in FIG. 1.
Figure 14B:
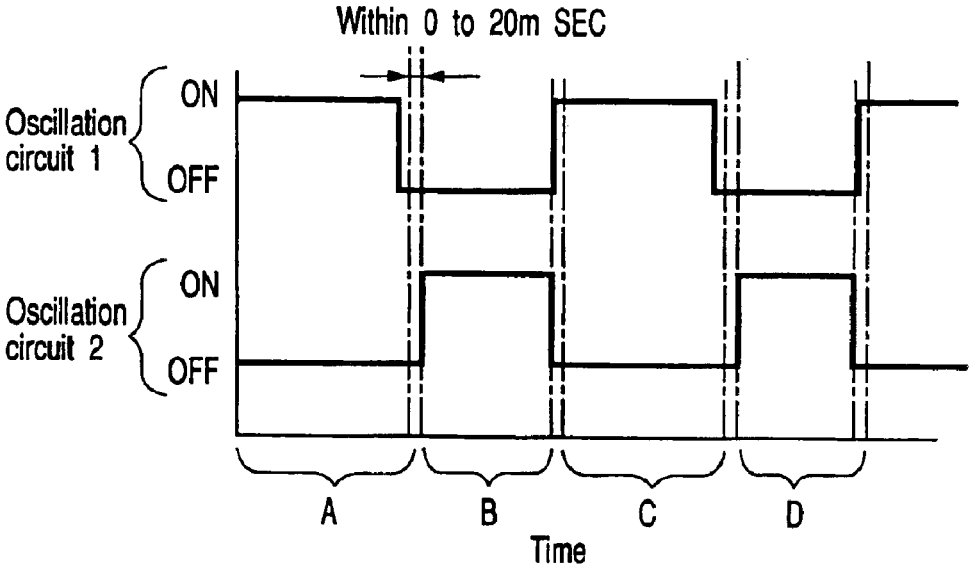
FIG. 14B is a schematic view illustrating an example of the switching timing when supplying predetermined power to each coil of the fixing mechanism illustrated in FIG. 1 by the drive device depicted in FIG. 14A.

FIG. 14A illustrates an example of a drive device capable of supplying predetermined power to individual coils in the fixing mechanism illustrated in FIG. 1. It is to be noted that FIG. 14B illustrates an example of the switching timing when supplying predetermined power to individual coils in the fixing mechanism shown in FIG. 1 by the drive device illustrated in FIG. 14A. In addition, FIG. 15 illustrates the drive device shown in FIG. 14 in detail.

In FIG. 14A, the induction coil is divided into a central coil 141*a* and both end coils 141*b* and 141*c*, and the both end coils 141*b* and 141*c* among these coils are driven by the same control mode or same condition (since they are connected in series).

As a coil driving mode, i.e., a method of supplying power to individual coils, there can be considered a method which energizes all the coils during the warming-up and switches a coil to be driven (target to which power is supplied) by the control according to needs in any other case.

Presuming that all the coils are simultaneously energized at the time of warming-up, an output which can be allowed to the fixing mechanism is a sum of outputs from the central coil 141*a* and the both end coils 141*b* and 141*c*. It is to be noted that the output indicates a power conversion value outputted from each coil in order to provide the magnetic flux to generate an eddy current, which is a heat source of the heat roller 11, from each coil to the heat roller, and substantially corresponds to power consumption consumed by the coil.

For example, it is assumed that power available as a heat source of the fixing mechanism is up to 1400 W during the warming-up when any other machine parts of a copying machine are all not operating and it is 900 W at the time of copying (image formation). In this case, an output from the central coil 141*a* is up to 700 W, and outputs from the both end coils 141*b* and 141*c* are 700 W in total.

A frequency of each coil is usually variable and these coils are mainly operated with the same timing. However, when a plurality of coils are simultaneously driven, the buzzing is generated due to a small difference in frequency.

The buzzing generated by switching a coil as a drive target (coil to which the power is supplied) can be prevented by using a half bridge mode which is forcible oscillation. However, a number of switching elements is increased for example, which leads to increase in cost.

Therefore, in regard to each of a plurality of the coils, a maximum value of the output allowed for the heating source of the fixing mechanism is determined as 1400 W with respect to the central coil and the both end coils during the warming-up, and these coils are alternately driven (coil to which the power is supplied is switched). Then, the output of 1400 W does not fluctuate. Further, at the time of copying, by setting each frequency variable and adjusting the output, the allowable maximum output can be used for heating a part which requires the heat roller. In this case, the drive circuit can utilize the semi-E class mode which is inexpensive self-excited oscillation.

At this moment, since a range of the frequency which can oscillate is restricted in induction heating, it is necessary to design in such a manner that each coil can obtained the same output at substantially the same frequency in order to extensively use the output range by a plurality of the coils.

For the above-described reason, in this embodiment according to the present invention, the coil constant of each coil is set so as to obtain the output of 700 W to 1400 W in the frequency range of 20 kHz to 40 kHz when 100 V is used as a power supply voltage. The upper limit of the output from each coil is substantially the same, and this is a maximum value which can be supplied to the fixing machine.

Concretely, for example, assuming that a sum of outputs from the central coil and the both end coils is 1400 W with a frequency of approximately 21 kHz, the sum becomes 700 W at a frequency of approximately 39 kHz. An error of the inductance of the coils must be restricted to approximately ±30 $\mu$H.

Incidentally, when the central coil and the both end coils are alternately driven, the respective coils must not be simultaneously energized. Furthermore, when a difference in output of the individual coils is greater than a predetermined level, the voltage may drop in the same commercial power supply circuit. Therefore, as shown in FIG. 14B, a plurality of the coils are switched at the time of alternate energization with a difference in output being not more than 200 W, zero cross, and an interval in switching being not more than 0 to 20 msec.

By performing these controls by using a microcomputer, the timing operation during the alternate operation can be smoothly conducted. Moreover, even if the magnetic characteristic of the heat roller or the coil characteristic varies due to a change in temperature of the heat roller (by controlling using the single microcomputer) and the oscillation condition diverges, the smooth control can be enabled. This can simplify the control system and also decrease the cost as compared with the case of using a plurality of the microcomputers.

In addition, when the respective coils are alternately energized, it is convenient to use a method which gradually lowers the frequency (soft start) without suddenly raising to a predetermined output with a variable frequency.

Incidentally, it is also possible to use a method which passes a current with a predetermined frequency, calculates the power and then adjusts the output by controlling the frequency.

Additionally, it is also possible to determine a frequency and an output based on the conditions of the previous energization.

The above-described soft start is managed within 0.5 second from a point in time when the power is supplied to a coil to which the power should be supplied. Thereafter, a frequency is determined based on the conditions of the previous energization, respectively. The output is detected and corrected. It is to be noted that the output is detected by detecting the inputted voltage and current.

Figure 15:
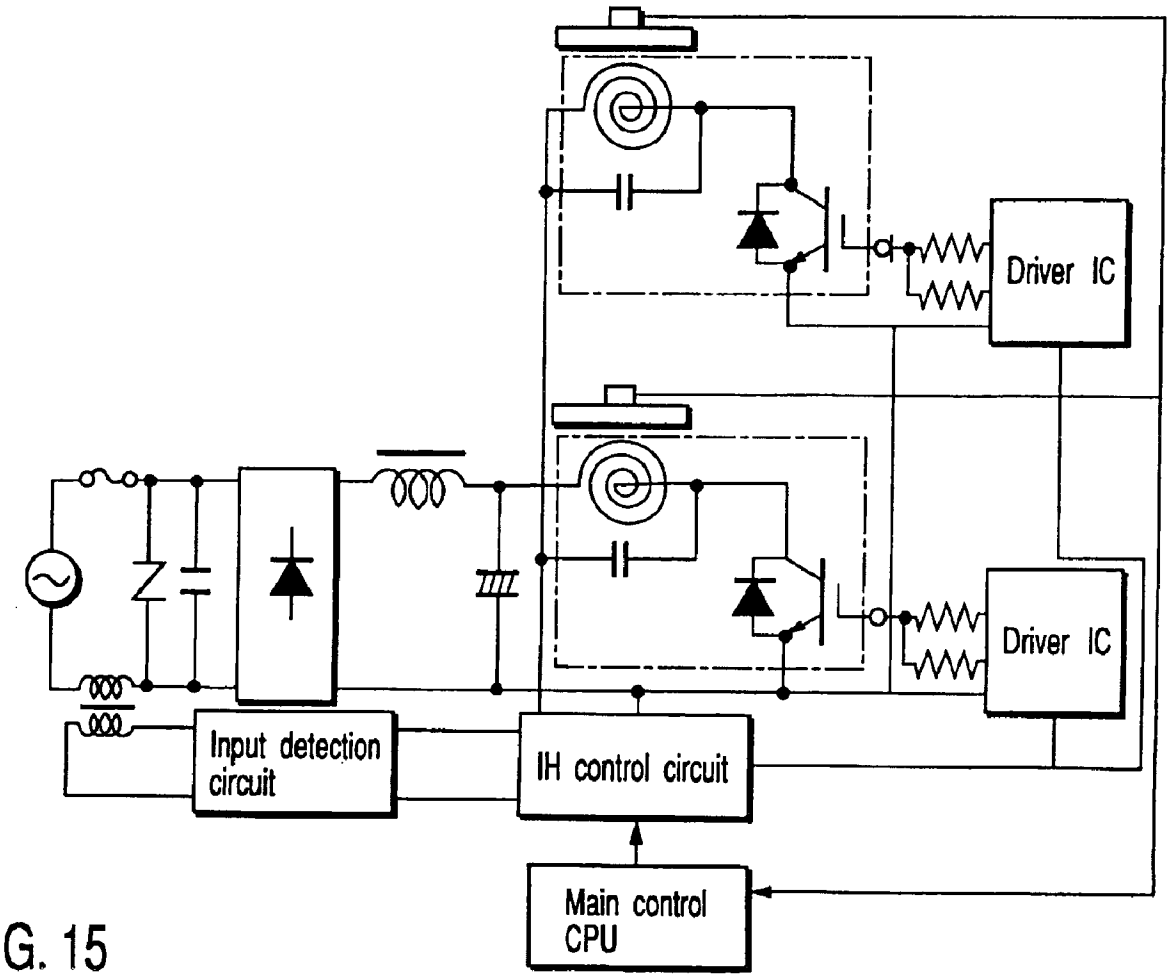
FIG. 15 is a circuit diagram showing an example which illustrates the drive device depicted in FIG. 14A in detail.

Incidentally, as shown in FIG. 15, in this embodiment according to the present invention, the drive circuit which supplies predetermined power to each coil in the fixing mechanism includes one power supply portion (circuit which smoothes the alternating current to the direct current) and a plurality of oscillation portions for the respective coils. They are controlled by one microcomputer as described above. Incidentally, although the semi-E class circuit is used as the drive circuit, the similar advantage can be obtained when the half bridge or full bridge mode is used.

Further, as shown in FIG. 15, a temperature of the heat roller which generates heat when each coil is energized is detected by a thermistor provided at a position corresponding to the coil of the heat roller, and a temperature of the coil itself is detected by temperature detecting means, respectively. It is to be noted that the heat generation status is monitored and a thermostat is also provided.

Since an energization time of each coil in alternate energization can be constantly switched since the consumption status of the thermal energy and the temperature are detected by the above-described temperature detecting means. However, for example, some drive patterns may be defined in advance and any pattern may be selected based on the operation status of the copying machine main body (for example, in the warming-up, in the copying, in the copying of the small-size paper and in the ready mode) and a temperature detected by the temperature detecting means.

As examples of the patterns, there are two-second energization to the central coil +one-second energization to the both end coils, two-second energization to the central coil +0.5-second energization to the both end coils, and others. Furthermore, since a temperature of each coil is detected as a temperature of the heat roller at a corresponding position, it is possible to energize the coil whose detected temperature is low. In this case, it is needless to say that the upper and lower limits of the set temperature must be set.

Figure 23:
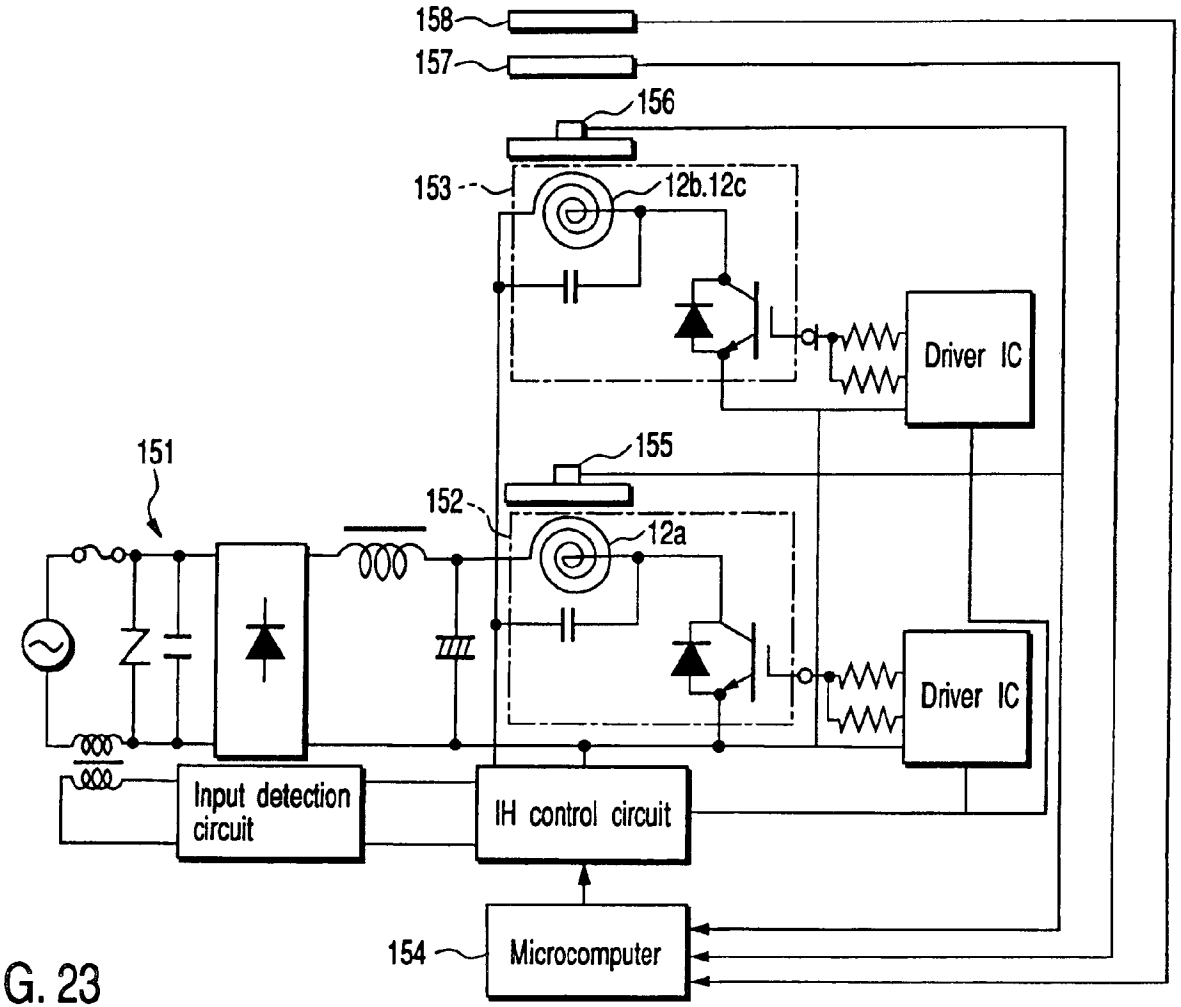
FIG. 23 is a circuit diagram showing an example illustrating the drive device depicted in FIG. 15 in detail.

It is to be noted that the drive circuit shown in FIG. 15 is substantially equivalent to the drive circuit shown in FIG. 23.

That is, the drive circuit includes a power supply portion 151 which is a circuit for smoothening the alternating current to the direct current, an oscillation portion for a central coil 12*a*, i.e., a first switching portion 152, and an oscillation portion for end coils 12*b* and 12*c*, i.e., a second switching circuit 153. They are controlled by one microcomputer 154 as described above. Incidentally, although the semi-E class circuit is used for the drive circuit, the similar advantage can be obtained when the half bridge or full bridge mode is used.

Incidentally, although already described, when the central coil (a) and the both end coils (b, c) are alternately driven, namely, when the power is alternately supplied to the coil (a) and the coils (b, c), the individual coils must not be simultaneously energized. Furthermore, when a difference in output from the individual coils is greater than a predetermined level, the voltage may drop in the same commercial power supply circuit every time the coil as a target to which the power is supplied is switched. Therefore, as already described in connection with FIG. 14B, a difference in output of the individual coils at the time of alternate energization is set to 200 W, namely, not more than 20% of 1400 W. Incidentally, as the timing for switching the coil to be energized, i.e., the timing at which the coil to which the power is supplied is switched, there is used zero cross with which the polarity of the alternating output before rectifying the input power supply (commercial power supply) is counterchanged. In this case, an interval of energization at the time of switching is not more than 0 to 20 msec with respect to the zero cross.

By controlling these members by the single microcomputer which is independently provided for temperature control of the fixing mechanism, the timing operation at the time of alternate operation can be smoothly conducted. Moreover, even if the magnetic characteristic of the heat roller or the coil characteristic varies due to a change in temperature of the heat roller and the oscillation condition, i.e., an output of each coil varies by the control of the single microcomputer, the smooth control can be enabled.

In addition, as apparent from FIG. 23, a temperature of the heat roller which generates heat when each coil is energized is detected by the thermistors 155 and 156 provided at positions corresponding to the coils of the heat roller, and a temperature of the coil itself is detected by an inner thermistor 157 illustrated in FIG. 1, respectively. It is to be noted that the heat generation status is monitored and there is also provided a thermostat 158 which detects abnormal heat generation to interrupt the power to be supplied to each coil.

Additionally, when alternately energizing the respective coils, it is beneficial to employ a method which gradually lowers the frequency without suddenly raising to a predetermined output with a variable frequency.

The above-described method which does not suddenly apply a maximum value of the power which can be inputted to the coils is known as the soft start.

The above-mentioned soft start is preferably managed within 0.5 second as already described. Thereafter, the frequency is determined based on the conditions of the immediately preceding or previous energization. The output is detected and corrected with a predetermined timing. It is to be noted that the coil output, i.e., the power consumed by the coil is detected by detecting the inputted voltage and current.

Since the time of energization to each coil can be constantly switched when the power is alternately supplied to each coil since the consumption status of the thermal energy and the temperature are detected by the above-described temperature detecting means, i.e., thermistors in this manner. Incidentally, as already described, any pattern may be selected based on the operation status of the copying machine main body (for example, in the warming-up, in the copying, in the copying of the small-size paper, and in the ready mode or the like) and a temperature detected by the temperature detecting means.

Figure 16:
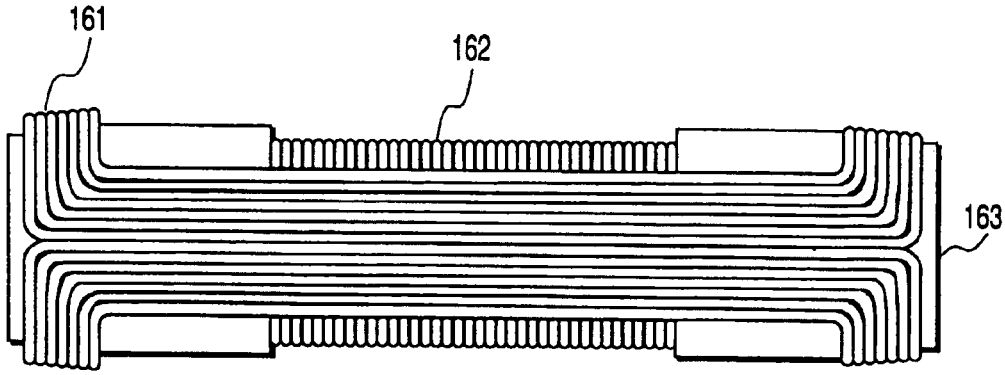
FIG. 16 is a schematic view which illustrates an example of an induction coil which can be applied to the fixing mechanism depicted in FIG. 1 and includes a coil part wound overlapping in a part of the longitudinal direction.
Figure 17A:
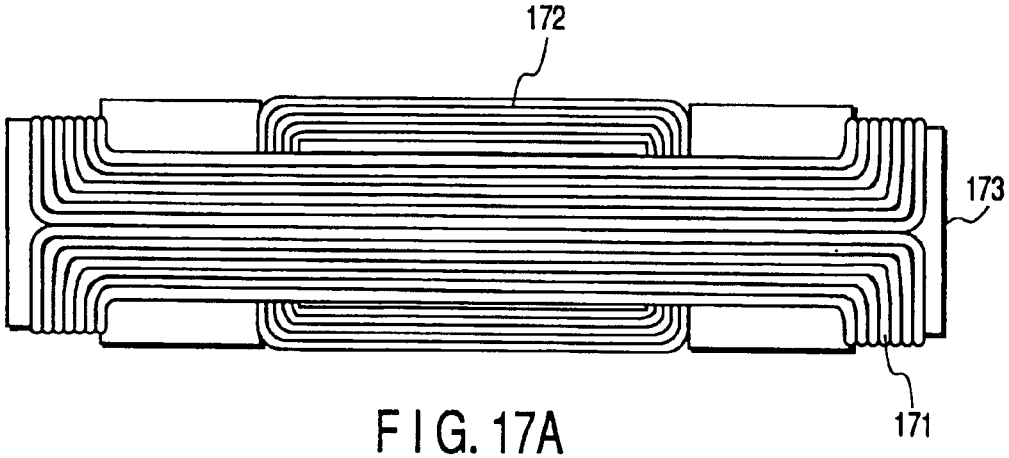
FIGS. 17A and 17B are schematic views illustrating modifications of the induction coil depicted in FIG. 16.
Figure 17B:
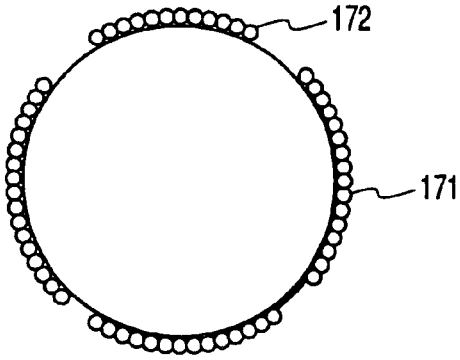
Figure 18:
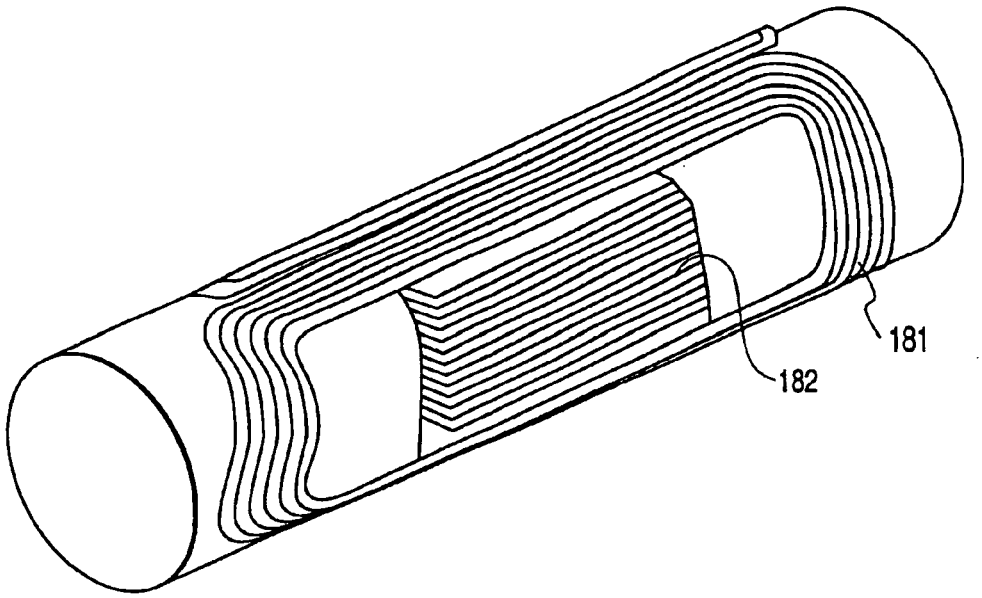
FIG. 18 is a schematic view illustrating another modification of the induction coil depicted in FIG. 16.
Figure 19:
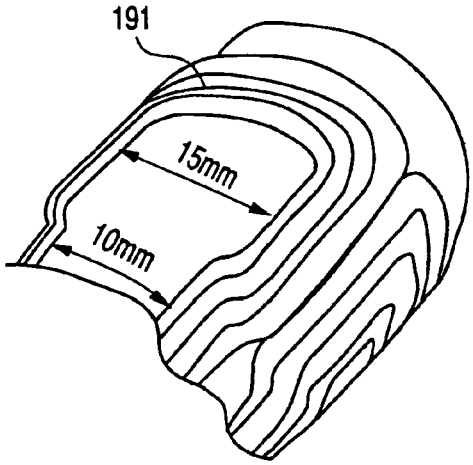
FIG. 19 is a schematic view illustrating an example of a winding shape of the coil electric wire of the coil end portion which can be applied to the induction coils depicted in FIGS. 16, 17A, 17B and 18.

FIG. 16 illustrates an example of an electromagnetic induction coil which can be applied to the fixing mechanism shown in FIG. 1 and includes coil parts wound overlapping each other in a part of the longitudinal direction. FIGS. 17A and 17B illustrate modifications of the electromagnetic induction coil shown in FIG. 16. FIG. 18 illustrates another modification of the electromagnetic induction coil shown in FIG. 16. FIG. 19 illustrates an example of the winding shape of the coil electric wire at the coil end portion which can be applied to the electromagnetic induction coils shown in FIGS. 16, 17A, 17B and 18.

FIGS. 16, 17A, 17B, 18 and 19 illustrate examples in which the induction coil having a double structure consisting of an outer coil from which the main maximum performance must be essentially brought out and which corresponds to a maximum length of the paper to be heated and an inner coil which is arranged on the inner side of the outer coil and corresponds to the small-size paper, respectively.

The induction coil shown in FIG. 16 has an inner coil 162 which is a solenoidal coil wound along the rotational axis of the heat roller and an outer coil 161 which is wound along the axial direction (planar type) in order to reduce the loss caused by the respective coils, and magnetic field generation directions forms a right angle. A magnetic substance core 163 is arranged inside the core material of this induction coil.

In the induction coils shown in FIGS. 17A, 17B and 18, both the outer coil 171 (181) and the inner coil 172 (182) are wound along the axial direction. Incidentally, as apparent from FIG. 17B, when seeing the cross section of the central part of the induction coil, the arrangement of the wire material is well designed so as not to overlap the outer coil 171 and the inner coil 172 each other.

Incidentally, as to the outer coil of the induction coil in particular, heat generation at the both end portions of the coil must be reinforced as compared with the central part because of a problem of heat radiation to the both end portions from the open part of the heat roller and heat taken by the bearing or the like.

Therefore, when the both end portions of the coil are hollow, reducing the offset of the magnetic flux by increasing a distance between electric wires at each end portion of the coil 191 can suffice (for example, the minimum portion is increased from 10 mm to 15 mm), or an interval between the electric wire and the heat roller at each end portion may be narrowed (from 2 mm to 3 mm), as shown in FIG. 19.

Moreover, when the both end portions of the coil have the core, the width of the core may be widened at each end portion (from 5 mm to 8 mm), or the distance between the end portion of the core and the heat roller may be reduced (from 8 mm to 4 mm).

Incidentally, by reducing the distance between the core and the heat roller, a drop in temperature immediately after the warming-up time can be uniformly suppressed (within 10° C.) in the rotational axis direction of the heat roller. In addition, as to drive of the coil, the outer first coil is energized at the time of warming-up or regular copying, but only the inner coil is driven when the small-size paper is printed or the both end portions generate heat to a set value or higher.

At that moment, since the range of a frequency which can be oscillated is restricted in induction heating, it is necessary to design in such a manner that the respective coils can obtain the same output at the same frequency in order extensively use the output range by a plurality of the coils.

Incidentally, as already described above, the above-described fixing mechanism is set so as to obtain an output of 700 W to 1400 W at a frequency of 20 kHz to 40 kHz when the power supply voltage is 100 V. Additionally, the upper limits of the outputs are substantially the same and become a maximum value which is allowed to the fixing mechanism. In order to realize this, a plurality of the coils must be substantially the same.

In this case, in order to alternately drive the outer coil and the inner coil, they must not be simultaneously energized. Incidentally, if a difference in output from these coils is large, the voltage of the same power supply line may be lowered when alternately driving the coils, and hence an output difference is suppressed to 200 W or lower at the time of alternate energization. Further, although already described in connection with FIG. 14B, the timing for switching the coil as an energization target is an interval not more than 20 msec from zero cross.

Figure 20A:
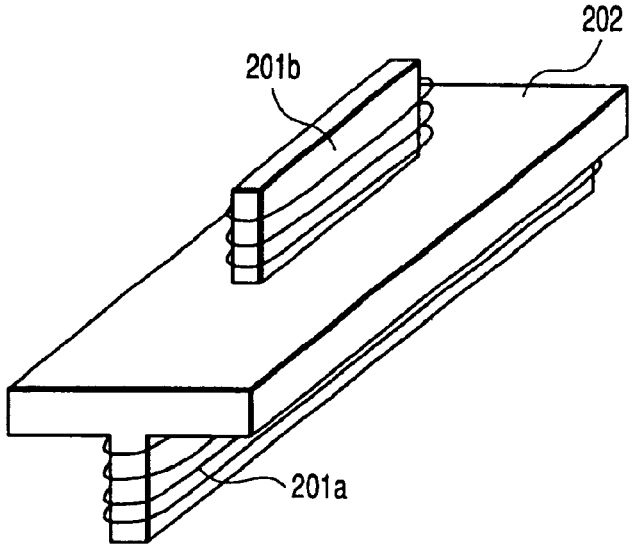
FIGS. 20A and 20B are schematic views showing examples of an induction coil which is another embodiment of the induction coil which can be applied to the fixing mechanism depicted in FIG. 1, and includes a coil having two heat generation widths in two areas partitioned by the magnetic substance core.
Figure 20B:
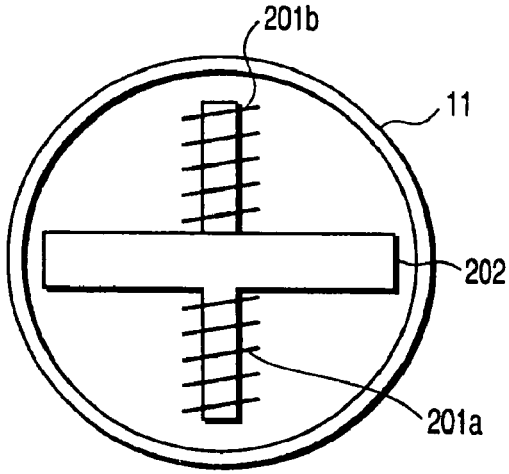

FIGS. 20A and 20B illustrate examples of an electromagnetic induction coil which is still another embodiment of the electromagnetic induction coil which can be applied to a fixing mechanism shown in FIG. 1, and includes coils having two heat generation widths in two areas partitioned by the magnetic substance core. Furthermore, FIG. 21 illustrates a modification of the electromagnetic induction coil having two heat generation widths in two areas partitioned by the magnetic substance core shown in FIGS. 20A and 20B.

Figure 21:
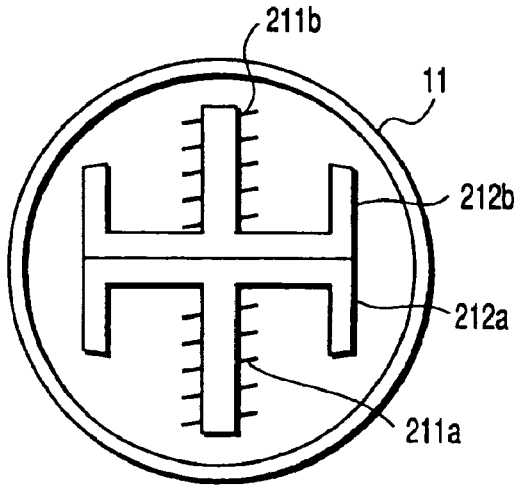
FIG. 21 is a schematic view illustrating a modification of the induction coil having two heat generation widths in areas partitioned by the magnetic substance core depicted in FIGS. 20A and 20B.

The induction coils shown in FIGS. 20A, 20B and 21 are examples of preventing leak of the magnetic flux generated by the coil by using the magnetic substance core and configuring the coil having a plurality of heat generation widths by combining the magnetic substance cores.

As shown in FIGS. 20A and 20B, the induction coil consists of a long coil 201*a* and a short coil 201*b*. The electric wire of the long coil 201*a* is wound around a part of the core 202 which protrudes downwards. The electric wire of the short coil 201*b* is wound around a part which protrudes upwards so as to be back to back with respect to the long coil 201*a*.

The coil shown in FIG. 21 uses two E-shaped cores such as those in a trans back to back. The electric wire of the long coil 211*a* is wound around the lower E-shaped core 212*a*, and the electric wire of the short coil 211*b* is wound around the upper E-shaped core 212*b*.

Each of the induction coils shown in FIGS. 20A, 20B and 21 drives the opposed short coil when a temperature at the both end portions is increased, e.g., when the machine is started by using the long coil corresponding to the maximum paper width and the small-size paper is inserted. As a result, it is possible to prevent a temperature at the parts of the heat roller corresponding to the both end portions of the coil from increasing.

As described above, since the present invention is configured to include therein a plurality of the air coils having no magnetic substance core inside, it is possible to obtain the fixing mechanism having the inexpensive and light-weight induction coil.

Further, since there is provided the mechanism which prevents a temperature of the endless member corresponding to the joint of the adjacent coils divided into a plurality of coils from lowering, a large drop in temperature at the joint part of the coils can be avoided even if all the divided coils are energized to cope with the large-size paper.

Furthermore, by providing the mechanism which prevents a temperature of the endless member corresponding to the both ends of the unit coil consisting of a plurality of divided coils from lowering, it is possible to prevent reduction in temperature at the both end portions immediately after the warming-up.

Incidentally, the above-described various kinds of embodiments have the following inherent advantages.

1. Since a plurality of the air coils having no magnetic substance core inside are provided, it is possible to configure the inexpensive and light-weight coil.

2. In the coil having a plurality of the divided coils, by inclining the joint part of each coil by a predetermined angle in a direction vertical to the moving direction of the heating object, a large drop in temperature can be prevented at the joint part of the coil even if all the divided coils are energized to cope with the large-size paper.

3. In the fixing mechanism having the magnetic substance core and including coils divided in a direction vertical to the moving direction of the heating object, by inclining the end portion of the core of each coil having the core by a predetermined angle in a direction vertical to the moving direction of the heating object, a large drop in temperature can be prevented at the joint part of the coil even if all the divided coils are energized to cope with the large-size paper.

4. In the mixing mechanism having a plurality of coils divided in the direction vertical to the moving direction of the heating object by induction heating, since the shape of the end portion of the core of coil having the core among the respective coils is formed so as to protrude at least at either the upper part or the lower part and include the electric wire portion, and hence disconnection of the magnetic flux generated due to turnback of the electric wire can be eliminated. As a result, even in the case of energizing all the divided coils to cope with the large-size paper, large reduction in temperature at the joint part of the coils can be avoided.

5. In the induction heating fixing mechanism which includes a plurality of coils in a direction vertical to the fixation member carrying direction and supports these coils by the same holder, by increasing the distance between a pair of the coil electric wires in the vicinity of the joint portion of each coil, the offset of the magnetic flux is reduced at the both end portions of the coil, the heat generation efficiency is improved, thereby reducing reduction in temperature at the joint part.

6. In the induction heating fixing mechanism which includes a plurality of coils in a direction vertical to the fixation member carrying direction and supports these coils by the same holder, by widening the thickness of the magnetic substance core in the vicinity of the joint portion of each coil, the offset of the magnetic flux is reduced at the both end portions of the coil, the heat generation efficiency is improved, thereby reducing reduction in temperature at the joint part.

7. In the induction heating fixing mechanism which includes a plurality of coils in a direction vertical to the fixation member carrying direction and supports these coils by the same holder, by increasing the thickness of the magnetic substance core in the vicinity of the joint part of each coil, the offset of the magnetic flux is reduced at the both end portions of the coil, the heat generation efficiency is improved, thereby reducing a drop in temperature at this joint part.

8. In the induction heating fixing mechanism which includes a plurality of coils in a direction vertical to the carrying direction of the fixation member to be heated and supports these coils by the same holder, when the heat roller having a small wall thickness is used in particular, the thermal energy is not taken by the bearings or the like at the both ends rather than the heat roller itself, and reduction in temperature can be decreased even immediately after the warming-up.

9. In the induction heating fixing mechanism which includes a plurality of coils and supports these coils by the same holder, by narrowing the interval between the heating object and the coil in the vicinity of the joint part of each coil, a temperature at the joint part of each divided coil can be prevented from lowering.

10. In the induction heating fixing mechanism which includes a plurality of coils having the magnetic substance core and supports these coils by the same holder, by narrowing the gap between the heating object and the core in the vicinity of the joint part of each coil, a temperature at the joint part of each divided coil can be prevented from lowering.

11. By narrowing the gap between the heating object and the coil in the vicinity of the end portion of the coil at each of the both ends in the longitudinal direction of a plurality of divided coils, a temperature at the both end portions can be prevented from lowering immediately after the warming-up.

12. By narrowing the gap between the heating object and the core in the vicinity of the end portion of the coil at each of the both ends in the longitudinal direction of a plurality of divided coils having the magnetic substance core, a temperature at the both end portions can be prevented from lowering immediately after the warming-up.

13. A plurality of coils are provided in a direction vertical to the carrying direction of the fixation member to be heated, there coils are used independently or some of them are connected to form one coil, and power consumed during the continuous operation when operation at the same drive frequency by using the same power supply is set substantially equal to the integral power at the time of alternate operation. As a result, the calorific value can be controlled depending on the paper size, and the warming-up time can be shortened.

14. There is provided the composite coil having a so-called solenoidal coil and a coil which is longer than the solenoidal coil, wound around in the direction vertical to the carrying direction of the heating object and provided outside the solenoidal coil, and the coils are switched in accordance with the size of the paper to be inserted. As a result, stable heat generation can be performed without combining the divided coils in accordance with the paper size.

15. In the induction heating fixing mechanism configured to double the coil, by increasing the distance between the opposed coil electric wires (pair) at each of the both end portions of the coil which is long in the direction vertical to the carrying direction of the heating object, the offset of the magnetic flux is avoided, thereby preventing a temperature at the both end portions from lowering immediately after the warming-up.

16. In the induction heating fixing mechanism configured to double the coil, by reducing the distance between the heating object and the electric wire at the both end portions of the coil which is long at least in a direction vertical to the carrying direction of the heating object, a temperature at the both end portions can be prevented from lowering immediately after the warming-up by increasing the width of the core and causing the generated magnetic flux to effectively act.

17. In the induction heating fixing mechanism configured to double the coil, when the magnetic substance core is provided at the both end portions of the coil which is long at least in a direction vertical to the carrying direction of the heating object, a temperature at the both end portions can be prevented from lowering immediately after the warming-up by increasing the width of the core and causing the generated magnetic flux to effectively act.

18. In the induction heating fixing mechanism configured to double the coil, when the magnetic substance core is provided at the both end portions of the coil which is long at least in a direction vertical to the carrying direction of the heating object, a temperature at the both end portions immediately after the warming-up can be prevented from lowering by reducing the distance between the core and the heating object and causing the generated magnetic flux to effectively act.

19. Two or more parts partitioned by the magnetic substance are provided inside and the coils having different heat generation portions are arranged in these parts, thereby providing the coils having the independent performances in one mechanism.

20. By controlling a plurality of the coils having different heat generation widths or outputs by using one microcomputer, individual energization to the divided coils can be smoothly carried out, thereby realizing reduction in the cost.

21. In the coil of the induction heating fixing mechanism configured by combining a plurality of the coils, inductances of a plurality of these coils are different, and the output can be adjusted to 200 W or lower even though the inductances are different.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. The heating mechanism comprising:

a cylindrical heating member which supplies heat to a sheet and which includes a central axis;

a first coil body which comprises a first magnetic core and which increases temperature of the heating member, wherein the first magnetic core (i) extends parallel to the central axis; (ii) comprises two end portions; (iii) comprises a first portion having electric wire material arranged therein and having a first length in the direction of the central axis; and (iv) comprises a second portion having a second length different from the first length in the direction of the central axis; and a second coil body which comprises a second magnetic core and which increases the temperature of the heating member, the second magnetic core extending parallel to the central axis and having two end portions, wherein at least one end portion opposes a first magnetic core end portion in the direction of the central axis.

2. The heating mechanism according to claim 1, wherein the second portion of the first magnetic core has at least one projection at an end portion opposing the second magnetic core.

3. The heating mechanism according to claim 1, wherein the second magnetic core has a third portion having a third length in the direction of the central axis and having electric material arranged therein, and a fourth portion having a fourth length in the direction of the central axis, wherein the third length differs from the fourth length.

4. The heating mechanism according to claim 3, wherein the second portion of the first magnetic core has a projection at least one end portion, and the fourth portion of the second magnetic core has at least one projection at an end portion opposing the first magnetic core.

5. The heating mechanism according to claim 4, wherein the second portion of the first magnetic core opposes the fourth portion of the second magnetic core in the direction of the central axis.

6. The heating mechanism according to claim 3, wherein the first portion of the first magnetic core opposes the fourth portion of the second magnetic core in the direction of the central axis, and the second portion of the first magnetic core opposes the third portion of the second magnetic core in the direction of the central axis.

7. The heating mechanism according to claim 6, wherein the projection included in the second portion of the first magnetic core opposes the projection included in the fourth portion of the second magnetic core, in a direction orthogonal to the central axis.

8. The heating mechanism according to claim 1, wherein a distance between the first portion of the first magnetic core and the third portion of the second magnetic core is shorter than a distance between the second portion of the first magnetic core and the fourth portion of the second magnetic core.

9. The heating mechanism according to claim 1, wherein the first coil body has a coil member wound around the first magnetic core along a direction orthogonal to the central axis, and the second coil body bus a coil member wound around the second magnetic core along the direction orthogonal to he central axis.

10. A heating mechanism comprising:

a cylindrical beating member which supplies heat to a sheet and which includes a central axis;

a first coil body which includes a first magnetic core and which increases a temperature of the heating member, the first magnetic core extending parallel to the central axis and having two end portions, wherein at least one end portion has a first surface forming a predetermined angle relative to the central axis; and a second coil body which includes a second magnetic core and which increases the temperature of the heating member, the second magnetic core extending parallel to the central axis and having two end portions, wherein at least one end portion has a second surface forming a predetermined angle relative to the central axis, the first surface having a portion opposing the second surface in a direction orthogonal to the central axis, wherein the first and the second surfaces form an angle between 5 and 60 degrees with respect to the central axis.

11. A heating mechanism comprising:

a cylindrical heating member which supplies heat to a sheet and which includes a central axis;

a first coil which increases temperature of the heating member and which includes portions away from the heating member by different distances; and a second coil which increases the temperature of the heating member and which includes portions away from the heating member by different distances, wherein the second coil is closest to the heating member at a second coil end portion adjacent to the first coil.

12. A heating mechanism comprising:

a cylindrical heating member which supplies heat to a sheet and which includes a central axis;

a first coil body which includes a first magnetic core and which increases temperature of the heating member, the first magnetic core including portions away from the heating member by different distances; and a second coil body which includes a second magnetic core and which increases the temperature of the heating member, the second magnetic core including portions away from the heating member by different distances, wherein the second magnetic core is closest to the heating member at a second magnetic core end portion adjacent to the first magnetic core.

* * * * *